US009090979B2

(12) United States Patent
Okuyama et al.

(10) Patent No.: US 9,090,979 B2
(45) Date of Patent: Jul. 28, 2015

(54) METHOD AND APPARATUS FOR MANUFACTURING PERCHLORATE

(75) Inventors: Junichi Okuyama, Yokohama (JP); Kumiko Yoshihisa, Yokohama (JP); Yasunori Hamano, Yokohama (JP); Takahiro Matsuo, Yokohama (JP); Nobuhiko Kubota, Sagamihara (JP); Kazuo Uematsu, Yokohama (JP); Muneo Ayabe, Yokohama (JP)

(73) Assignee: IHI CORPORATION (JP)

( * ) Notice: Subject to any disclaimer, the term of this patent is extended or adjusted under 35 U.S.C. 154(b) by 972 days.

(21) Appl. No.: 13/260,399

(22) PCT Filed: Mar. 26, 2010

(86) PCT No.: PCT/JP2010/002226

§ 371 (c)(1),
(2), (4) Date: Sep. 26, 2011

(87) PCT Pub. No.: WO2010/109922

PCT Pub. Date: Sep. 30, 2010

(65) Prior Publication Data

US 2012/0020871 A1 Jan. 26, 2012

(30) Foreign Application Priority Data

Mar. 26, 2009 (JP) ..... P2009-076221
Jul. 29, 2009 (JP) ..... P2009-176629

(51) Int. Cl.
*C25B 1/28* (2006.01)
*C25B 15/08* (2006.01)

(52) U.S. Cl.
CPC .. *C25B 1/28* (2013.01); *C25B 15/08* (2013.01)

(58) Field of Classification Search
USPC ..... 205/474, 473
See application file for complete search history.

(56) References Cited

U.S. PATENT DOCUMENTS 3,928,546 A 12/1975 Guzzo ..... 423/476
4,627,899 A 12/1986 Smith et al. ..... 204/95

(Continued)

FOREIGN PATENT DOCUMENTS

CN 1042574 A 5/1990
CN 1052152 A 6/1991

(Continued)

OTHER PUBLICATIONS

Notice of Allowance dated Jan. 21, 2014 issued in corresponding Korean Patent Application No. 10-2011-7019585 with English translation.

(Continued)

*Primary Examiner* — Arun S Phasge
(74) *Attorney, Agent, or Firm* — Ostrolenk Faber LLP

(57) ABSTRACT

Disclosed is a method for producing perchlorate, which comprises: an electrolytic step (S1) wherein an electrolysis vessel (2), in which a positive electrode side (4A) on which a positive electrode (4) is arranged and a negative electrode side (5A) on which a negative electrode (5) is arranged are divided by a cation-exchange membrane (6), is used and an aqueous solution of sodium chlorate is electrolytically oxidized on the positive electrode side (4A) of the electrolysis vessel (2); a neutralization reaction step (S2) wherein a substance an aqueous solution of which shows alkalinity is added to the aqueous perchloric acid solution that has been produced by the electrolytic oxidation on the positive electrode side, so that perchlorate is synthesized by a neutralization reaction; and a crystallization process wherein the perchlorate synthesized by the neutralization reaction is obtained as crystals. The crystallization process is composed of an evaporative crystallization step (S3), or alternatively composed of three steps, namely an evaporative concentration step (S21), a cooling crystallization step (S22), and a separation step (S23).

14 Claims, 26 Drawing Sheets

(56) References Cited

U.S. PATENT DOCUMENTS

| | | | | | |
|---|---|---|---|---|---|
| 5,004,527 | A | | 4/1991 | Millet et al. | 204/82 |
| 5,009,754 | A | | 4/1991 | Pralus | 204/82 |
| 5,104,499 | A | * | 4/1992 | Millet | 205/474 |
| 5,131,989 | A | * | 7/1992 | Dotson et al. | 205/474 |
| 5,160,416 | A | * | 11/1992 | Cawlfield et al. | 205/474 |
| 2004/0011663 | A1 | | 1/2004 | Bossoutrot | 205/474 |

FOREIGN PATENT DOCUMENTS

| | | | |
|---|---|---|---|
| JP | 42-016947 | | 9/1967 |
| JP | 47-012312 | | 6/1972 |
| JP | 58-136786 | | 8/1983 |
| JP | 2-182888 | | 7/1990 |
| JP | 3-199387 | | 8/1991 |
| JP | 6-086671 | | 11/1994 |
| JP | 2006-044975 | | 2/2006 |
| JP | 2007-197740 | | 8/2007 |
| KR | 10-1992-0001522 | B1 | 2/1992 |
| KR | 10-1992-0008515 | B1 | 10/1992 |
| KR | 10-0498836 | B1 | 7/2005 |
| WO | WO 93/12034 | | 6/1993 |

OTHER PUBLICATIONS

Office Action dated May 21, 2013 issued in corresponding Japanese Patent Application No. 2011-505902 with English translation.

Office Action dated Sep. 17, 2013 issued in corresponding Chinese Patent Application No. 201080013891.4 with English translation (17 pages).

International Search Report and Written Opinion mailed May 25, 2010 in corresponding PCT International Application No. PCT/JP2010/002226.

"Manufacture of Perchloric Acid and Perchlorates," J.C. Schumacher (ed.), Perchlorates, A.C.S. Monograph No. 146, Reinhold, New York, pp. 71-103, 1960.

"Propellant Handbook," by the propellant division in Japan Explosives Society, pp. 87-89, 2005, with English translation.

Jun-Hyung Kim, "Preparation of Fine Ammonium Perchlorate Crystals by a 'Salting Out' Process," J. Chem. Eng. Japan, 28(4), pp. 429-433, 1995.

Extended European Search Report dated Feb. 18, 2015 in corresponding European Application No. 10755723.3.

* cited by examiner

METHOD AND APPARATUS FOR MANUFACTURING PERCHLORATE

CROSS-REFERENCE TO RELATED APPLICATIONS

The present application is a 35 U.S.C. §§371 national phase conversion of PCT/JP2010/002226, filed Mar. 26, 2010, which claims priority of Japanese Patent Application Nos. 2009-076221 and 2009-176629, filed Mar. 26, 2009 and Jul. 29, 2009, respectively, the contents of which are incorporated herein by reference. The PCT International Application was published in the Japanese language.

TECHNICAL FIELD

The present invention relates to a method and an apparatus for manufacturing a perchlorate.

Priorities are claimed on Japanese Patent Application No. 2009-076221, filed Mar. 26, 2009, and Japanese Patent Application No. 2009-176629, filed Jul. 29, 2009, the contents of which are incorporated herein by reference.

TECHNICAL BACKGROUND

A perchlorate, as described in detail in Non-Patent Document 1 or 2 below, is manufactured industrially by electrolytically oxidizing an aqueous solution of sodium chlorate that has been synthesized by electrolytically oxidizing an aqueous solution of sodium chloride and then performing a predetermined treatment. Here, examples of an electrolysis cell (an electrolysis tank) used for electrolytically oxidizing the aqueous solution of sodium chloride include a diaphragm-free cell described in Patent Document 4 below, in which no diaphragm is provided between electrodes, and an electrolysis cell described in Patent Document 1 or 2 below, in which a diaphragm is provided between electrodes.

Here, a method of industrially manufacturing a perchlorate will be described using ammonium perchlorate as an example. A conventional method of industrially manufacturing ammonium perchlorate consists of, roughly, the following two processes.

(1) Electrolytic oxidation of sodium perchlorate ($NaClO_4$)

(2) Metathetical reaction of sodium perchlorate and ammonium sulfate ($(NH_4)_2SO_4$)

In the process (1), an aqueous solution of sodium chlorate ($NaClO_3$) is electrolyzed without using a diaphragm so as to oxidize sodium chlorate and thus obtain sodium perchlorate. The entire reaction in the process (1) is expressed by the following chemical equation (a).

$$NaClO_3+H_2O \rightarrow NaClO_4+H_2 \quad (a)$$

Here, for example, a piece of titanium having platinum coated on the surfaces is used as the anode, and, for example, iron is used as the cathode.

In the process (2), ammonium sulfate ($(NH_4)_2SO_4$) is added to the aqueous solution of sodium perchlorate, and ammonium perchlorate ($NH_4ClO_4$) is obtained by a metathetical reaction. The entire reaction in the process (2) is expressed by the following chemical equation (b).

$$2NaClO_4+(NH_4)_2SO_4 \rightarrow 2NH_4ClO_4+Na_2SO_4 \quad (b)$$

Meanwhile, when ammonium perchlorate is used as an oxidizing agent of a propellant, there are cases in which the ammonium perchlorate needs to be, for example, fine crystals having a grain size of about 1 μm to 10 μm as described in Patent Document 3 below. Here, examples of a method of obtaining the fine crystals include a salting out method described in Non-Patent Document 3 or a method described in Patent Document 5, in which ammonia gas and the vapor of an anhydrous perchlorate are mixed so as to crystallize the ammonia perchlorate.

In addition, as another example of the method of industrially manufacturing a perchlorate, a method of manufacturing lithium perchlorate will be described. The method of industrially manufacturing lithium perchlorate consists of the following four processes including a process in which lithium perchlorate is manufactured from sodium chlorate.

(I) Manufacture of sodium perchlorate ($NaClO_4$)

(II) Manufacture of potassium perchlorate ($KClO_4$)

(III) Manufacture of perchloric acid ($HClO_4$)

(IV) Manufacture of lithium perchlorate ($LiClO_4$)

In the process (I), an aqueous solution of sodium chlorate ($NaClO_3$) is electrolyzed without using a diaphragm so as to oxidize sodium chlorate and thus obtain sodium perchlorate. The entire reaction in the process (I) is expressed by the following chemical equation (A).

$$NaClO_3+H_2O \rightarrow NaClO_4+H_2 \quad (A)$$

In the process (II), potassium chloride (KCl) is added to the aqueous solution of sodium perchlorate, and potassium perchlorate is obtained by a metathetical reaction. The entire reaction in the process (II) is expressed by the following chemical equation (B).

$$NaClO_4+KCl \rightarrow KClO_4+NaCl \quad (B)$$

Meanwhile, it is also possible to generate potassium perchlorate through the self-oxidation of potassium chlorate (as shown in the following chemical equation (C)), but the yield is low with respect to a raw material, and therefore this method is not suitable for mass production.

$$4KClO_3 \rightarrow 3KClO_4+KCl \quad (C)$$

In the process (III), the aqueous solution of potassium perchlorate is heated and decomposed using concentrated sulfuric acid ($H_2SO_4$). The entire reaction in the process (III) is expressed by the following chemical equation (D).

$$KClO_4+H_2SO_4 \rightarrow KHSO_4+HClO_4 \quad (D)$$

When the solution obtained in the above process is distilled in vacuum, an anhydrous perchlorate is crystallized.

In the process (IV), lithium carbonate ($Li_2CO_3$) is added to an aqueous solution of perchloric acid, and lithium perchlorate is synthesized through a neutralization reaction. In addition, the aqueous solution of lithium perchlorate synthesized by the neutralization reaction is evaporated and crystallized so as to obtain lithium perchlorate trihydrate. The neutralization reaction in the process (IV) is expressed by the following chemical equation (E).

$$2HClO_4+Li_2CO_3 \rightarrow 2LiClO_4+CO_2+H_2O \quad (D)$$

DOCUMENTS OF THE PRIOR ART

Patent Documents

[Patent Document 1] JP-A-3-199387
[Patent Document 2] JP-A-2007-197740
[Patent Document 3] JP-A-2006-44975
[Patent Document 4] JP-B-6-86671
[Patent Document 5] JP-A-47-012312

Non-Patent Documents

[Non-Patent Document 1] J. C. Schumacher (ed.), Perchlorates, A. C. S. Monograph No. 146, Reinhold, N.Y., 1960
[Non-Patent Document 2] Propellant Handbook, by the propellant division in Japan Explosives Society, 2005

[Non-Patent Document 3] Jun-Hyung Kim, Preparation of fine ammonium perchlorate crystals by a "salting out" process, J. Chem. Eng. Japan, 28(4), 429-433, 1995

DISCLOSURE OF THE INVENTION

Problems to be Solved by the Invention

However, in the conventional method of industrially manufacturing a perchlorate, sodium dichromate ($Na_2Cr_2O_7$) is added to the solution as an anti-reducing agent in order to prevent sodium chlorate, which is a raw material, from being reduced to sodium chloride (NaCl) at the cathode when an aqueous solution of sodium chlorate is electrolytically oxidized as described in the process (1) and the process (I). The amount of sodium dichromate added to 1 liter of the solution is, for example, 2 g. As a result, the solution comes to contain hexavalent chromium which is highly toxic. Therefore, when the solution is disposed of, a disposal treatment for the environment, for example, a chromium liquid waste disposal treatment, in which hexavalent chromium in the solution is filtered to give chromium hydroxide, is required. Therefore, the conventional method, in which sodium dichromate is added, has problems with the environment or the costs for the disposal treatment.

In addition, in the process (2), when ammonium perchlorate is extracted as crystals, since sodium sulfate ($Na_2SO_4$) is crystallized together with ammonium perchlorate, it is necessary to separate the crystallized sodium sulfate.

In addition, in the process (II) in the method of manufacturing lithium perchlorate, since sodium chloride is crystallized together with potassium perchlorate, it is necessary to separate the crystallized sodium chloride.

Therefore, in the conventional method of synthesizing a perchlorate, the processes for obtaining the perchlorate are complicated. Meanwhile, Patent Document 4 describes a method in which sodium perchlorate is continuously manufactured with no diaphragm provided between electrodes, but there are no studies regarding a method of efficiently manufacturing a perchlorate other than sodium perchlorate, such as ammonium perchlorate or lithium perchlorate, and, furthermore, sodium dichromate is added to the aqueous solution when the aqueous solution containing sodium perchlorate, which is a raw material, is electrolytically oxidized.

In addition, Patent Document 1 or 2 describes a method of manufacturing sodium perchlorate using an electrolysis cell in which a diaphragm is provided between electrodes, but there are no studies with the purpose of improving the processes of manufacturing a perchlorate, such as ammonium perchlorate or lithium perchlorate. Also, there are no studies with the purpose of coping with the variation in the demand for various types of perchlorates and manufacturing a perchlorate with a minimum of facilities. Therefore, there is a demand for providing a method and an apparatus for improving and simplifying the conventional processes of manufacturing a perchlorate other than sodium perchlorate, which includes the above problems.

The invention has been made in consideration of the above problems, and the object of the invention is to provide a method and an apparatus for manufacturing a perchlorate which considers the influences on the environment, the reduction in costs for disposal treatment, and the simplification of the processes of manufacturing a perchlorate.

Means for Solving the Problem

In order to solve the above problems, the invention relates to (1) a method of manufacturing a perchlorate, including an electrolysis process in which, using an electrolysis tank in which an anode section provided with an anode and a cathode section provided with a cathode are divided by a cation-exchange membrane, an aqueous solution of sodium chlorate is electrolytically oxidized in the anode section, and a neutralization reaction process in which a substance that becomes alkaline when dissolved in water is added to the aqueous solution of perchloric acid in the anode section, which has been generated by the electrolytic oxidation, so as to synthesize a perchlorate by a neutralization reaction.

(2) In the method of manufacturing a perchlorate according to the above (1), the alkaline substance that is added to the aqueous solution of perchloric acid in the anode section, which has been generated by the electrolytic oxidation during the neutralization reaction, may be ammonia gas or an aqueous solution of ammonia.

(3) The method of manufacturing a perchlorate according to the above (1) or (2) may also include an evaporation and crystallization process in which the perchlorate synthesized by the neutralization reaction process is formed into crystals.

(4) The method of manufacturing a perchlorate according to the above (1) or (2) may also include an evaporation and concentration process in which the perchlorate synthesized by the neutralization reaction process is evaporated and concentrated, a cooling and crystallization process in which the liquid evaporated and concentrated in the evaporation and concentration process is cooled and formed into crystals, and a separation process in which crystals are separated from the liquid cooled and crystallized in the cooling and crystallization process.

Thereby, it is possible to obtain a perchlorate having a higher purity than a perchlorate formed into crystals in the process (3).

(5) In the method of manufacturing a perchlorate according to any one of the above (1) to (4), the anode may be an electrode having a noble metal catalytic layer on the surface of the substrate.

With such a configuration, it is possible to efficiently perform the electrolytic oxidation of the aqueous solution of sodium chlorate.

(6) In the method of manufacturing a perchlorate according to any one of the above (1) to (3) and (5), the anode may be an electrode having a platinum catalytic layer on the surface of the substrate, and an absorption process in which at least a part of the platinum that is eluted by the electrolytic oxidation is absorbed and recovered by an absorbent is provided between the electrolytic oxidation process and the synthesis process.

Thereby, it becomes possible to reuse platinum which is a rare metal.

(7) The method of manufacturing a perchlorate according to the above (1) to (3) and (5) to (6) may also include between the electrolysis process and the neutralization reaction process an impurity removal process in which, from the aqueous solution of perchloric acid in the anode section generated by the electrolytic oxidation, sodium ions and chlorate ions included in the aqueous solution are crystallized and separated as sodium chlorate crystals and sodium perchlorate crystals.

Thereby, it becomes possible to obtain the crystals of a perchlorate having a higher purity in the subsequent evaporation and crystallization process.

(8) The method of manufacturing a perchlorate according to the above (1) to (3) and (5) to (7) may also include between the impurity removal process and the neutralization reaction process, a sodium ion removal process in which, using a cation exchange tank filled with a hydrogen ion-type ion-exchange resin that substitutes sodium ions with hydrogen ions, sodium ions included in the aqueous solution of perchloric acid after the impurity removal process are substituted with hydrogen ions, thereby removing sodium ions.

Thereby, it becomes possible to obtain the crystals of a perchlorate having a higher purity in the subsequent evaporation and crystallization process than the manufacturing process of a perchlorate including the impurity removal process.

(9) In addition, the invention relates to an apparatus for manufacturing a perchlorate, including an electrolysis tank in which an anode section provided with an anode and a cathode section provided with a cathode are divided by a cation-exchange membrane, and an aqueous solution of sodium chlorate is electrolytically oxidized in the anode section, and a neutralization reaction tank in which a substance that becomes alkaline when dissolved in water is added to the aqueous solution of perchloric acid in the anode section, which has been generated by the electrolytic oxidation, so as to synthesize a perchlorate by a neutralization reaction.

(10) The apparatus for manufacturing a perchlorate according to the above (9) may also include an evaporation and crystallization tank in which the aqueous solution of a perchlorate synthesized by the neutralization reaction tank is evaporated and formed into crystals.

(11) The apparatus for manufacturing a perchlorate according to the above (9) may also include an evaporation and concentration tank in which the aqueous solution of the perchlorate synthesized in the neutralization reaction tank is evaporated and concentrated, a cooling and crystallization tank in which the liquid evaporated and concentrated in the evaporation and concentration tank is cooled and formed into crystals, and a separation tank in which crystals are separated from the liquid cooled and crystallized in the cooling and crystallization tank.

(12) In the apparatus for manufacturing a perchlorate according to the above (11), the neutralization reaction tank and the evaporation and concentration tank may be provided in the same tank.

Thereby, it becomes possible to reduce the size of manufacturing facilities and installation spaces.

(13) In the apparatus for manufacturing a perchlorate according to the above (9) to (12), the anode may be an electrode having a noble metal catalytic layer on the surface of the substrate.

(14) In the apparatus for manufacturing a perchlorate according to any one of the above (9) to (10) and (13), the anode may be an electrode having a platinum catalytic layer on the surface of the substrate, and an absorption tower in which at least a part of the platinum that is eluted by the electrolytic oxidation is absorbed and recovered by an absorbent is provided between the electrolysis tank and the neutralization reaction tank.

(15) The apparatus for manufacturing a perchlorate according to any one of the above (9) to (10) and (13) to (14) may also include between the electrolysis tank and the neutralization reaction tank, an evaporation and concentration tank and a cooling and crystallization tank in which, from the aqueous solution of perchloric acid in the anode section generated by the electrolytic oxidation, sodium ions and chlorate ions included in the aqueous solution are crystallized and separated as sodium chlorate crystals and sodium perchlorate crystals.

(16) The apparatus for manufacturing a perchlorate according to any one of the above (9) to (10) and (13) to (15) may also include between the cooling and crystallization tank and the neutralization reaction tank, a cation exchange tank which is filled with a hydrogen ion-type ion-exchange resin that substitutes sodium ions with hydrogen ions, and substitutes sodium ions included in the aqueous solution of perchloric acid after cooling and crystallization.

Effects of the Invention

Therefore, in the invention, it is possible to provide a method of manufacturing a perchlorate which considers the influences on the environment, the reduction in costs for disposal treatment, and the simplification of the manufacturing processes.

BEST EMBODIMENTS FOR IMPLEMENTING THE INVENTION

Hereinafter, a method and an apparatus for manufacturing a perchlorate according to embodiments of the invention will be described with reference to the drawings.

Here, first to fifth and eleventh embodiments will describe a method and an apparatus for manufacturing ammonium perchlorate, which is a perchlorate; sixth to ninth embodiments will describe a method and an apparatus for manufacturing lithium perchlorate, which is a perchlorate; and a tenth embodiment will describe a method and an apparatus for manufacturing potassium perchlorate, which is a perchlorate.

First Embodiment

Figure 1:
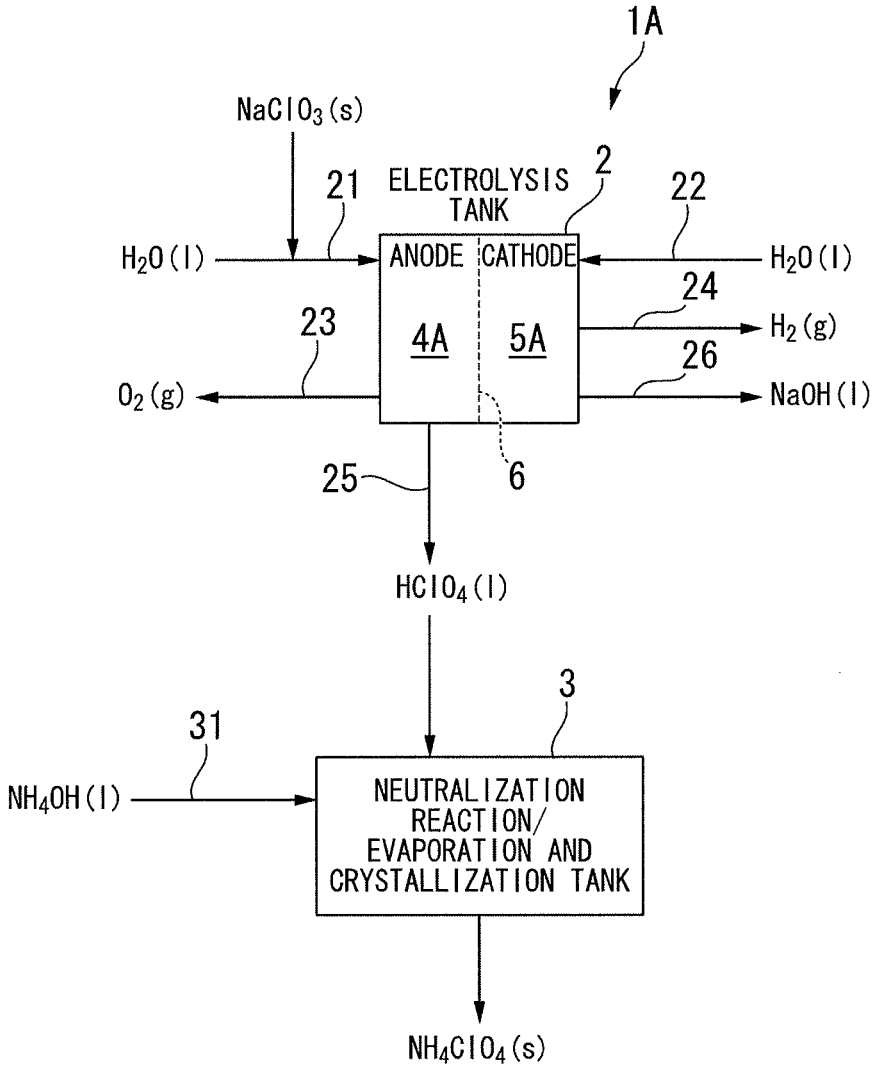
FIG. 1 is a schematic configuration view of an apparatus for manufacturing ammonium perchlorate according to a first embodiment of the invention.

FIG. 1 is a schematic configuration view of an apparatus 1A of manufacturing ammonium perchlorate according to a first embodiment of the invention. Here, the signs 'g', 'l', and 's' in the drawing indicate the states of gas, liquid, and solid, respectively. The apparatus for manufacturing ammonium perchlorate is provided with an electrolysis tank 2 and a neutralization reaction/evaporation and crystallization tank 3.

Figure 2:
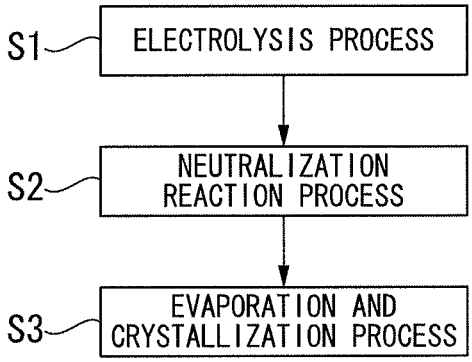
FIG. 2 is a flow chart of a process of manufacturing ammonium perchlorate according to the first embodiment of the invention.

FIG. 2 is a flow chart of the process according to the first embodiment of the invention, and the embodiment includes an "electrolysis process S1" a "neutralization reaction process S2" and an "evaporation and crystallization process S3."

Figure 3:
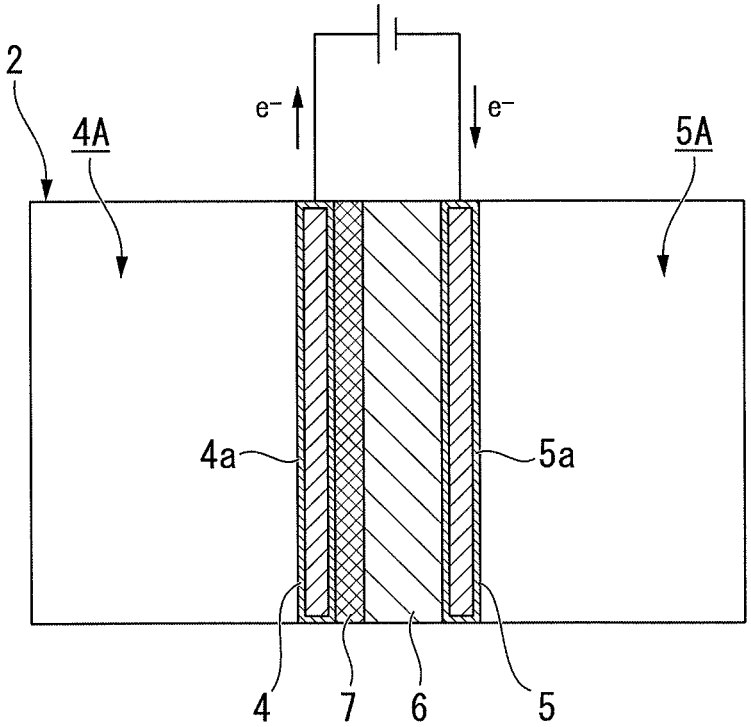
FIG. 3 is a configuration view of an electrolysis tank according to the first embodiment of the invention.

FIG. 3 is a configuration view of the electrolysis tank 2 according to the first embodiment of the invention.

As shown in FIG. 3, the electrolysis tank 2 includes an anode 4, a cathode 5, a cation-exchange membrane 6, and a platinum net (a net-shaped body) 7. Meanwhile, in the electrolysis tank 2, a solution in the anode section (an anode fluid) becomes highly acidic, and a solution in the cathode section (a cathode fluid) becomes highly alkaline by the electrolytic oxidation as described below. Therefore, as the main body of the electrolysis tank 2, it is desirable to use a material which is excellent in terms of stability with respect to chemicals, for example, Teflon (manufactured by E. I. du Pont de Nemours & Company, registered trade mark), vinyl chloride, or glass. In addition, as the joints of pipes, it is desirable to use a material which is excellent in terms of stability with respect to chemicals, for example, Teflon.

The anode 4 is made up of an electrode having a noble metal catalytic layer 4*a* on the surface of the substrate. The anode 4 in the embodiment is made up of an electrode of a platinum-coated titanium expanded metal in which the substrate of titanium is coated with a catalyst of platinum. Similarly to the anode 4, the cathode 5 in the embodiment is made up of an electrode of a platinum-coated titanium expanded metal in which the substrate of titanium is coated with a catalyst of platinum.

The cation-exchange membrane 6 is provided so as to divide the anode section 4A provided with the anode 4 and the cathode section 5A provided with the cathode 5. The cation-exchange membrane 6 composes a zero gap-type electrolysis cell in which the cation-exchange membrane 6 is tightly interposed between the anode 4 and the cathode 5 in the electrolysis tank 2 so as to cause no gap. The cation-exchange membrane 6 is a membrane with the property of allowing cations to pass through, but not allow anion to pass through, and, in the embodiment, Nafion 424 (manufactured by E. I. du Pont de Nemours & Company, registered trade mark) is used. Meanwhile, as the cation-exchange membrane, Aciplex (manufactured by Asahi Kasei Corporation, registered trade mark) or Flemion (manufactured by Asahi Kasei Corporation, registered trade mark), both of which are widely used to manufacture sodium hydroxide, may be used.

In addition, the platinum net 7 is interposed between the cation-exchange membrane 6 and the anode 4 in order to accelerate the electrolytic synthesis reaction of chlorate ions in the anode section 4A. Since the mesh of the platinum net 7 is finer than the mesh of the expanded metal in the anode 4, the platinum net 7 has a larger surface area that works as a catalyst.

The anode section 4A is connected with a pipe 21, and an aqueous solution of sodium chlorate is introduced through the pipe 21 so as to fill the anode section 4A. On the other hand, the cathode section 5A is connected with a pipe 22, and pure water is introduced through the pipe 22 so as to fill the cathode section 5A. When voltage is applied to both electrodes of the anode 4 and the cathode 5, the following reaction proceeds.

In the anode section 4A, the aqueous solution of sodium chlorate is electrolytically oxidized so as to generate perchlorate ions and oxygen gas as a byproduct as shown in the chemical equations (1) and (2) below. Meanwhile, although the amount is trace, ozone gas is also generated as a byproduct as shown in the chemical equation (3).

$$ClO_3^- + H_2O \rightarrow ClO_4^- + 2H^+ + 2e^- \quad (1)$$

$$2H_2O \rightarrow O_2 + 4H^+ + 4e^- \quad (2)$$

$$3H_2O \rightarrow O_3 + 6H^+ + 6e^- \quad (3)$$

Here, sodium ions included in the fluid in the anode section 4A move from the anode section 4A to the cathode section 5A through the cation-exchange membrane 6 due to the potential difference between both electrodes. On the other hand, chlorate ions cannot pass through the cation-exchange membrane 6 and turn into perchlorate ions by the reaction shown in the chemical equation (1) at the interface formed by the aqueous solution, the platinum net 7, and the cation-exchange membrane 6. Meanwhile, by using the platinum net 7 having a mesh smaller than the mesh of the expanded metal, it becomes possible to increase the reaction efficiency of the chemical equation (1). Toxic gas generated in the anode section 4A is sequentially exhausted outside through a pipe 23.

In the cathode section 5A, reactions shown in the chemical equations (4) and (5) below occur so that hydrogen gas and sodium hydroxide are generated.

$$2H^+ + 2e^- \rightarrow H_2 \quad (4)$$

$$2Na^+ + 2H_2O + 2e^- \rightarrow 2NaOH + H_2 \quad (5)$$

The hydrogen gas generated in the cathode section 5A is sequentially exhausted outside through a pipe 24.

When voltage is applied, and a predetermined time elapses so that a sufficient amount of perchlorate ions are generated, subsequently, the anode fluid is transported from the anode section 4A in the electrolysis tank 2 to the reaction/evaporation tank 3 through a pipe 25 shown in FIG. 1. On the other hand, the cathode fluid is transported outside from the cathode section 5A in the electrolysis tank 2 through a pipe 26.

In the neutralization reaction/evaporation and crystallization tank 3 in FIG. 1, ammonia gas is added to the electrolytically oxidized anode fluid so as to synthesize ammonium perchlorate, and the anode fluid is evaporated after the synthesis so that the ammonium perchlorate is formed into crystals.

The neutralization reaction/evaporation and crystallization tank 3 is connected with an ammonia supply pipe 31 so that an aqueous solution of ammonia is added to or ammonia gas is bubbled into the electrolytically oxidized anode fluid. When ammonia is added to the electrolytically oxidized anode fluid, a reaction shown in the chemical equation (6) below occurs so as to synthesize ammonium perchlorate.

$$HClO_4 + NH_4OH \rightarrow NH_4ClO_4 + H_2O \quad (6)$$

Next, the anode fluid is evaporated and concentrated by a heat source provided inside the neutralization reaction/evaporation and crystallization tank 3, and then the concentrated fluid is cooled so that ammonium perchlorate is formed into crystals. Since the byproduct obtained together with ammonium perchlorate by the process (6) is water, it is possible to obtain the crystals of ammonium perchlorate with no necessity of separating byproducts, such as sodium sulfate, unlike the related art.

The first embodiment employs a method of manufacturing a perchlorate (ammonium in the first embodiment) in which the electrolysis tank 2 in which the anode section 4A provided with the anode 4 and the cathode section 5A provided with the cathode 5 are divided by the cation-exchange membrane 6 is used and a process in which an aqueous solution of sodium perchlorate is electrolytically oxidized in the anode section 4A is included. By the electrolytic oxidation, sodium ions included in the aqueous solution of sodium perchlorate move from the anode section 4A to the cathode section 5A through the cation-exchange membrane 6, and, on the other hand, perchlorate ions in the aqueous solution of sodium perchlorate cannot pass through the cation-exchange membrane 6 and thus remain in the anode section 4A. As such, by separating sodium ions and perchlorate ions through the cation-exchange membrane 6, it is possible to prevent sodium perchlorate from being reduced at the cathode without adding sodium dichromate. In addition, it is possible to generate in the anode section 4A perchlorate that is necessary to manufacture a perchlorate (ammonium in the first embodiment).

Therefore, the first embodiment can provide a method of manufacturing a perchlorate (ammonium in the first embodiment) which considers the aspects of the environment and the cost for disposal treatment.

In addition, the first embodiment is provided with the neutralization reaction process S2 in which ammonia gas is added to the electrolytically oxidized anode fluid in the anode section 4A so as to synthesize ammonium perchlorate. In the synthesis process, since sodium ions are separated from the anode solution, it is not necessary to add ammonium sulfate so as to synthesize ammonium perchlorate by a metathetical reaction. Therefore, since it is possible to remove the process of separating byproducts generated by the metathetical reaction which was required in the related art, it becomes possible to achieve the simplification of the process of manufacturing ammonium perchlorate.

Meanwhile, as the additive used in the neutralization reaction, for example, an aqueous solution in which a hydroxide is dissolved or an alkaline aqueous solution in which carbonate is dissolved may be used. Here, a perchlorate is synthesized by the neutralization reaction of an aqueous solution in which the aqueous solution of perchloric acid, which has been generated in the electrolysis process, and a hydroxide are dissolved or an aqueous solution of in which the aqueous solution of perchloric acid, which has been generated in the electrolytical oxidation process, and a hydroxide are dissolved. Here, since the reaction generates a byproduct of water or water and carbon dioxide, the process for the separation of the byproduct which was necessary in the metathetical method of the related art becomes unnecessary, and thus it becomes possible to achieve simplification of the process of manufacturing a perchlorate.

Meanwhile, in comparison to the method of manufacturing ammonium perchlorate by mixing the vapor of anhydrous perchlorate and ammonia gas as described in Patent Document 5, in the manufacturing method according to the invention, in which an alkaline aqueous solution is added to an aqueous solution of perchloric acid so as to synthesize a perchlorate by a neutralization reaction, it is easy to manufacture perchlorate other than ammonium perchlorate. In addition, the process of manufacturing an anhydrous perchlorate is complicated as shown in the processes (I), (II), and (III), however, in the manufacturing method of the invention, a perchlorate is generated from sodium chlorate using an electrolysis cell in which a diaphragm is provided between electrodes, and therefore it is possible to manufacture a perchlorate with a smaller number of processes than the process disclosed in Patent Document 5.

Subsequently, an example of a test in which an apparatus for manufacturing ammonium perchlorate in the above configuration is used will be described.

In the present test, firstly, the electrolytic oxidation of an aqueous solution of sodium chlorate was performed in the electrolysis tank 2. Subsequently, the electrolyzed anode fluid was moved from the anode section 4A in the electrolysis tank 2 to the neutralization reaction/evaporation and crystallization tank 3 through the pipe 25, and an aqueous solution of ammonia was added to the anode fluid, thereby neutralizing the anode fluid. Finally, the neutralized aqueous solution was stirred and evaporated so as to form crystals. Hereinafter, each of the processes will be described in detail.

When the electrolytic oxidation of the aqueous solution of sodium chlorate was performed, 500 mL of ion-exchange water was introduced to the cathode section 5A, and an aqueous solution of sodium chlorate in which 160 g of sodium chlorate (manufactured by Kanto Chemical Co. Inc., with a purity of 99.0% or higher) was dissolved in 3.0 L of the ion-exchange water (about 0.5 mol/L) was introduced to the anode section 4A. Therefore, the anode fluid prior to the test contained a maximum of 42.3 g/L of chlorate ions and a maximum of 11.0 g/L of sodium ions.

The electrolytic oxidation of the aqueous solution of sodium chlorate was performed with a constant current of 12 A for a total sum of 24 hours spread of 5 days. Here, since the surface area of the electrode used in the test was 20 mm×40 mm, the electric current density became 1.5 A/cm$^2$. In addition, the fluid in the anode section was circulated at 600 mL/min using a chemical pump, and the test was performed at a temperature where a perchlorate was not decomposed, in which the temperature of water was controlled to 30° C. As a result of applying voltage to both electrodes, the voltage was reduced from 10.0 V to 5.5 V as time elapsed, and the amount of the fluid in the cathode section was increased from 500 mL in the initial phase to 1050 mL due to water accompanying the movement of the cations.

The componential analysis of the electrically oxidized anode fluid was performed using liquid ion chromatography. Here, in the componential analysis, the component was measured twice, that is, immediately after the electrolytic oxidation and one month after the electrolytic oxidation in order to confirm the reproducibility of the results. As a result, reproducibility was observed in the results. In addition, it was confirmed that the component of the electrolytically oxidized anode fluid did not vary as long as the fluid was stored at an environment of room temperature and in a glass vessel that was excellent in terms of stability with respect to chemicals. It was found that the chlorate ions in the anode fluid was reduced from 42.3 g/L in the initial phase to 0.85±0.05 g/L, and 45±1 g/L of perchlorate ions were generated. Therefore, the percentage at which chlorate ions are converted to perchlorate ions (the conversion percentage) became 98%. In addition, it was found that the sodium ions in the anode fluid reduced from 11.0 g/L to 1.4±0.1 g/L. Therefore, the migration percentage of sodium ions which moved to the cathode section 5A from the anode section 4A through the cation-exchange membrane 6 became 87%.

Further, the fact that the conversion percentage and the migration percentage were not 100% means that chlorate ions and sodium ions remained in the aqueous solution as impurities.

Meanwhile, as a result of analyzing the components of the electrolytically oxidized cathode fluid using liquid ion chromatography, it was found that 0.7 g/L of perchlorate ions were present in the cathode fluid. This result means that the perchlorate ions in the anode fluid passed through the cation-exchange membrane and moved to the cathode fluid. Here, it was confirmed that the movement of perchlorate ions which were driven by the concentration gradient between the anode fluid and the cathode fluid occurred while the electrolytic oxidation (the application of voltage to both electrodes) was on hold. Therefore, it was found that, in order to improve the conversion percentage of chlorate ions and achieve a higher purity of the aqueous solution of sodium hydroxide which is obtained as the byproduct, the electrolysis cell is preferably continuously operated.

In principle, it is possible to set the limit of the conversion percentage of chlorate ions to 100% and the limit of the migration percentage of sodium ions to 100% by the electrolytic oxidation of the sodium chlorate. However, this requires an excessive power supply, and therefore, once an appropriate conversion percentage of chlorate ions and an appropriate migration percentage of sodium ions are attained, it is preferable to separate chlorate ions and sodium ions present in the anode fluid by a method of, for example, cooling and crystallization, according to the finally required purity of sodium perchlorate. The cooling and crystallization will be described in detail in an eleventh embodiment.

Figure 4:
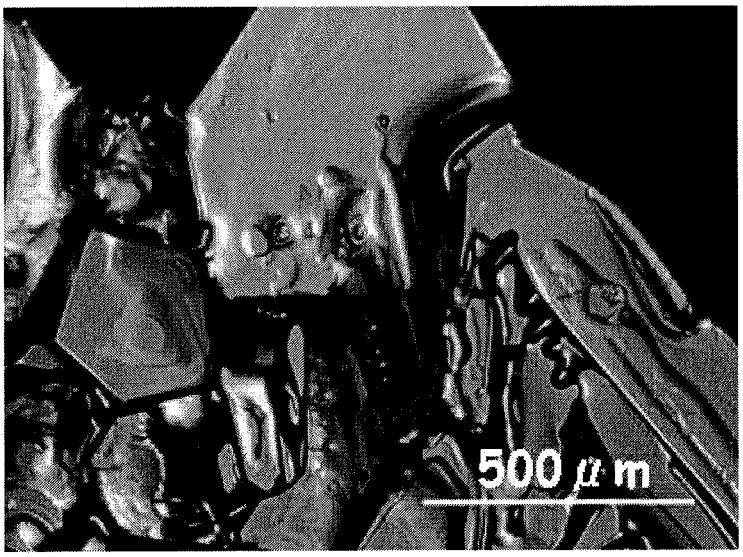
FIG. 4 shows a microscope photograph of the eutectic points of crystals obtained by the apparatus for manufacturing ammonium perchlorate according to the first embodiment of the invention.

The electrolytically oxidized anode fluid was moved from the anode section 4A in the electrolysis tank 2 to the neutralization reaction/evaporation and crystallization tank 3 through the pipe 25, and ammonia water was added to the anode fluid so as to neutralize the anode fluid. After that, the neutralized anode fluid was evaporated at 20° C. and in the atmosphere. As a result, 1 to 2 mm-sized grains were crystallized. FIG. 4 shows a microscope photograph of the eutectic points of grains crystallized by the evaporation process. From the observation of the eutectic point using a microscope, it was confirmed that the grains crystallized by the evaporation process were an aggregation of crystals, in which about 500 μm facets were developed.

Figure 5:
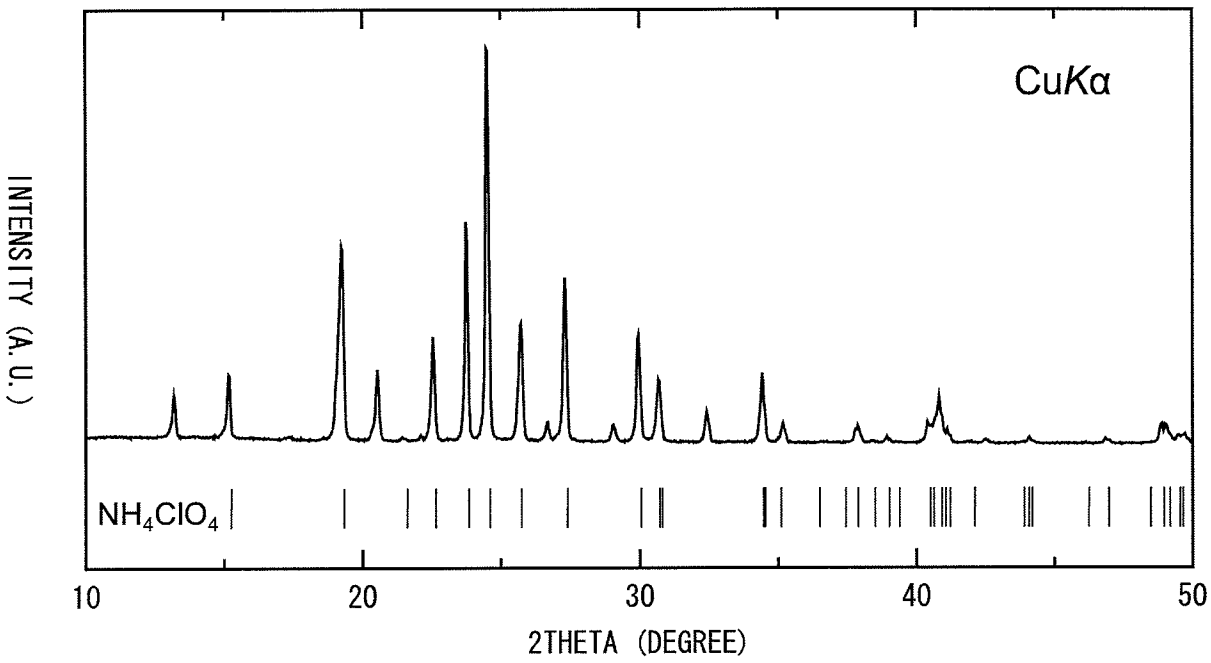
FIG. 5 shows a powder X-ray diffraction spectrum of the crystals obtained by the apparatus for manufacturing ammonium perchlorate according to the first embodiment of the invention.

FIG. 5 shows a powder X-ray diffraction spectrum of the crystals obtained in the test. In the drawing, the vertical axis indicates the diffraction intensity normalized by the highest X-ray diffraction intensity, and the horizontal axis indicates a diffraction angle of 2θ.

As shown in FIG. 4, the diffraction rays of the crystals obtained in the test matched the diffraction rays (discrete solid lines) of the standard specimen (reference: J. O. Lundgren, Acta Crystallogr., Sec. B, vol. 35, p. 1027, 1979) of ammonium perchlorate. That is, it was confirmed that the crystals of ammonium perchlorate were generated by the first embodiment.

Second Embodiment

Next, a second embodiment of the invention will be described with reference to FIGS. 6 to 8.

Figure 6:
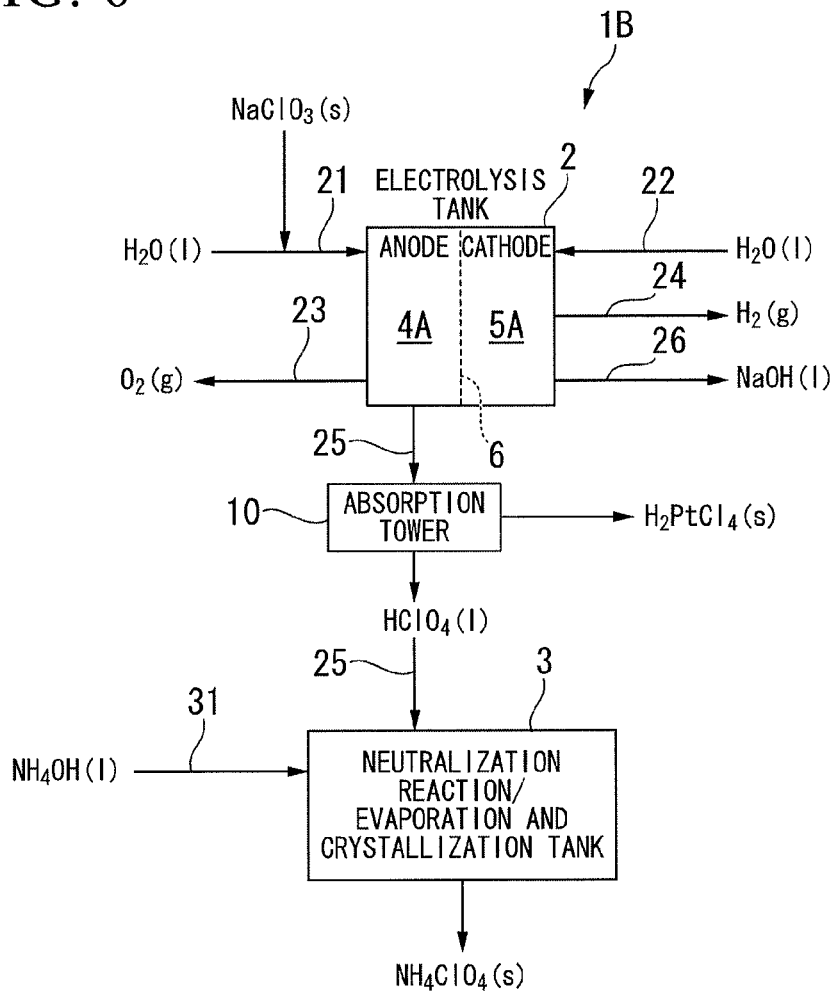
FIG. 6 is a schematic configuration view of an apparatus for manufacturing ammonium perchlorate according to a second embodiment of the invention.

FIG. 6 is a schematic configuration view of an apparatus 1B of manufacturing ammonium perchlorate according to the second embodiment of the invention. FIG. 7 is a flow chart of a process of manufacturing ammonium perchlorate according to the second embodiment. FIG. 8 is a configuration view of the apparatus 1B of manufacturing ammonium perchlorate according to the second embodiment of the invention.

Figure 7:
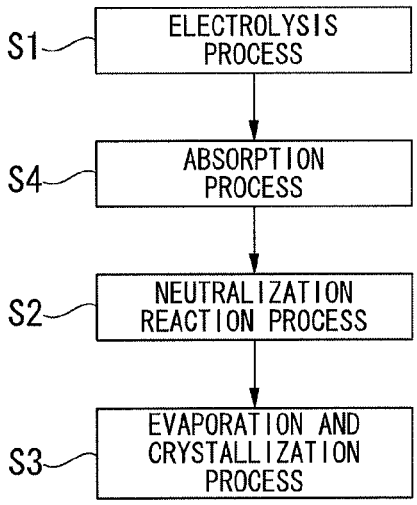
FIG. 7 is a flow chart of a process of manufacturing ammonium perchlorate according to the second embodiment of the invention.
Figure 8:
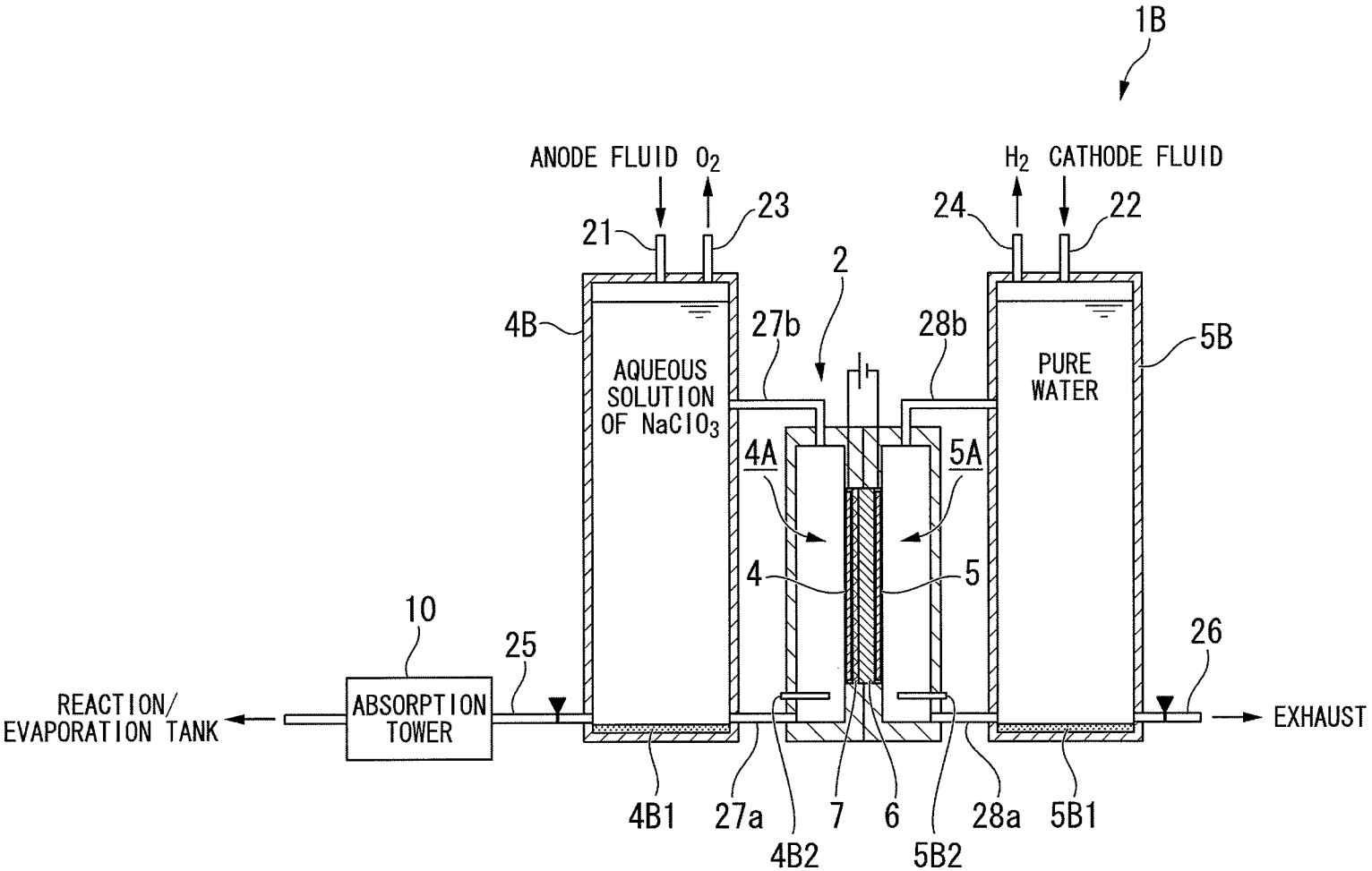
FIG. 8 is a configuration view of an apparatus for manufacturing ammonium perchlorate according to the second embodiment of the invention.

As shown in FIGS. 6 and 7, the apparatus 1B of manufacturing ammonium perchlorate according to the second embodiment is different from the first embodiment in that an absorption tower 10 is provided between the electrolysis tank 2 and the neutralization reaction/evaporation and crystallization tank 3 that absorbs platinum which is dissolved in the anode fluid by the electrolytical oxidation. In addition, the process is also different from the first embodiment in that an absorption process S4 is provided between the electrolysis process S1 and the neutralization reaction process S2. In addition, as shown in FIG. 8, the apparatus for manufacturing ammonium perchlorate according to the second embodiment is provided with an anode fluid tank 4B and a cathode fluid tank 5B and is connected with the respective pipes at different locations from the first embodiment. Firstly the configurations of the anode fluid tank 4B and the cathode fluid tank 5B will be described.

The anode section 4A in the electrolysis tank 2 is provided with the anode fluid tank 4B that stores the anode fluid. Here, the surface of the anode fluid in the anode fluid tank 4B is located higher than the electrolysis tank 2. The anode fluid tank 4B and the anode section 4A are connected through a pipe 27*a* and a pipe 27*b*. The pipe 27*a* connects the bottom portion of the anode section 4A in the electrolysis tank 2 and the bottom section of the anode fluid tank 4B. The pipe 27*b* connects the top portion of the anode section 4A in the electrolysis tank 2 and the side portion of the anode fluid tank 4B. In addition, in the second embodiment, the pipe 21 through which the anode fluid is introduced and the pipe 23 through which oxygen gas is exhausted are connected to the top portion of the anode fluid tank 4B, and the pipe 25 through which the anode fluid is transported to the neutralization reaction/evaporation and crystallization tank 3 is connected to the bottom portion of the anode fluid tank 4B.

Meanwhile, a heater 4B1 is provided at the bottom portion of the anode fluid tank 4B to heat the anode fluid. In addition, a thermocouple 4B2 is provided at the side portion of the anode section 4A in the electrolysis tank 2 to measure the temperature of the fluid.

On the other hand, the cathode section 5A in the electrolysis tank 2 is provided with the cathode fluid tank 5B that stores the cathode fluid. Here, the surface of the cathode fluid in the cathode fluid tank 5B is located higher than the electrolysis tank 2. The cathode fluid tank 5B and the cathode section 5A are connected through a pipe 28*a* and a pipe 28*b*. The pipe 28*a* connects the bottom portion of the cathode section 5A in the electrolysis tank 2 and the bottom section of the cathode fluid tank 5B. The pipe 28*b* connects the top portion of the cathode section 5A in the electrolysis tank 2 and the side portion of the cathode fluid tank 5B. In addition, in the second embodiment, the pipe 22 through which the cathode fluid is introduced and the pipe 24 through which oxygen gas is exhausted are connected to the top portion of the cathode fluid tank 5B, and the pipe 26 through which the cathode fluid is transported outside is connected to the bottom portion of the cathode fluid tank 5B.

Meanwhile, a heater 5B1 is provided at the bottom portion of the cathode fluid tank 5B to heat the cathode fluid. In addition, a thermocouple 5B2 is provided at the side portion of the cathode section 5A in the electrolysis tank 2 to measure the temperature of the fluid.

According to this configuration, oxygen gas generated by electrolytical oxidation and the anode fluid in the anode section 4A, including perchlorate ions, are introduced to the anode fluid tank 4B from the top portion of the anode section 4A in the electrolysis tank 2 through the pipe 27*b*. In addition, to the bottom portion of the anode section 4A in the electrolysis tank 2, the anode fluid is sequentially introduced from the anode fluid tank 4B through the pipe 27*a* due to the difference in the fluid surfaces (the difference in water pressure). Therefore, according to the configuration, it is possible to circulate the anode fluid between the anode section 4A in the electrolysis tank 2 and the anode fluid tank 4B without providing a driving mechanism, such as a pump. In addition, the same circulation action can be obtained even in the cathode section 5A.

The absorption tower 10 is provided at the pipe 25 and recovers ejected platinum between the electrolysis tank 2 and the neutralization reaction/evaporation and crystallization tank 3. The absorption tower 10 has an absorbing agent composed of porous activated charcoal therein.

When platinum or a platinum net 7 is used in the anode 4 as described in the second embodiment, there are cases in which platinum is dissolved in the anode fluid as chloroplatinic acid ions ($PtCl_4^{2-}$, $PtCl_6^{2-}$) in the electrolytical oxidation process. In the absorption tower 10, the anode fluid is passed through the absorbing agent so that platinum included in the solution is absorbed and recovered (absorption process S4). During the recovery, for example, the absorbing agent is dried, and platinum is recovered in the form of chloroplatinic acid or hexachloroplatinic acid ($H_2PtCl_6\ 6H_2O$).

Third Embodiment

Next, a third embodiment of the invention will be described with reference to FIGS. 9 to 11. The third embodiment is provided with the following configuration in order to increase the purity of the crystals of synthesized ammonium perchlorate.

Figure 9:
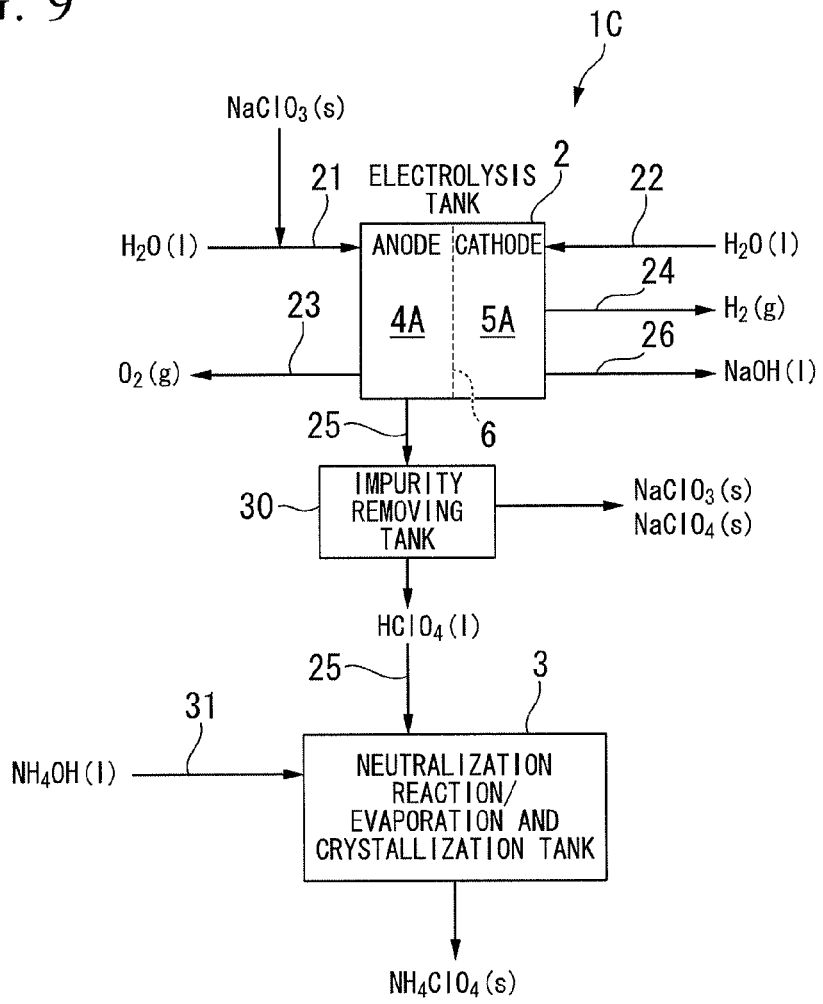
FIG. 9 is a schematic configuration view of an apparatus for manufacturing ammonium perchlorate according to a third embodiment of the invention.
Figure 10:
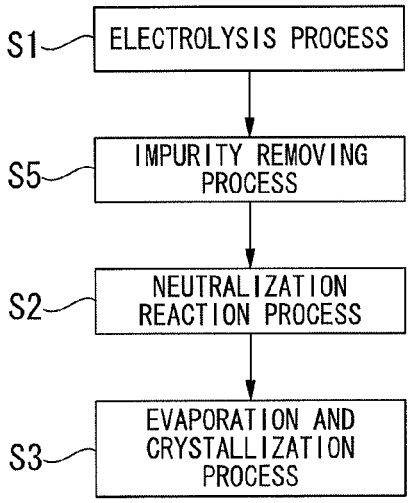
FIG. 10 is a flow chart of a process of manufacturing ammonium perchlorate according to the third embodiment of the invention.

FIG. 9 is a schematic configuration view of an apparatus 1C of manufacturing ammonium perchlorate according to the third embodiment of the invention. The apparatus 1C of manufacturing ammonium perchlorate according to the third embodiment is provided with an impurity removing tank 3 between the electrolysis tank 2 and the neutralization reaction/evaporation and crystallization tank 3 that separates sodium chlorate and sodium perchlorate remaining in the anode fluid which have undergone the electrolytic oxidation. FIG. 10 is a flow chart of a process of manufacturing ammonium perchlorate according to the third embodiment.

Figure 11:
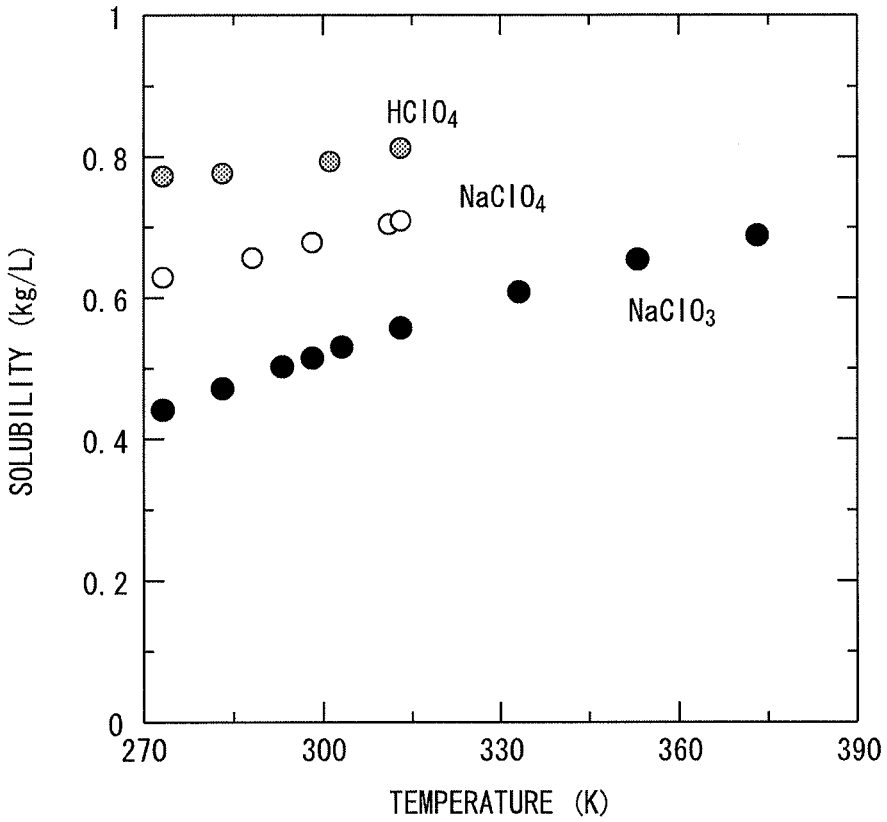
FIG. 11 is a graph showing the solubility of perchloric acid, sodium chlorate, and sodium perchlorate.

FIG. 11 is a graph showing the relationship of the solubility with the temperature variation of perchlorate, sodium chlorate, and sodium perchlorate (reference: Second basic edition of Chemistry Handbook by the Chemical Society of Japan, 1966, published by Maruzen Publishing Co., Ltd.). In the drawing, the vertical axis indicates the solubility, and the horizontal axis indicates the temperature.

In the apparatus C1 of manufacturing ammonium perchlorate, the synthesized anode fluid is evaporated in the neutralization reaction/evaporation and crystallization tank 3 so that ammonium perchlorate is formed into crystals. However, there are cases in which chlorate or sodium ions which fail to move to the cathode section 5A remain in the electrolysis tank 2. In this case, since sodium chlorate and sodium perchlorate are included, it is not possible to obtain the crystals of ammonium perchlorate having a high purity. Therefore, in the third embodiment, the impurity removing tank 30 is provided between the electrolysis tank 2 and the neutralization reaction/evaporation and crystallization tank 3 so that sodium chlorate and sodium perchlorate included in the anode fluid (considered as impurities) are crystallized and removed using the difference of solubility with perchlorate (an impurity removing process S5). Thereby, it is possible to obtain the crystals of a perchlorate (ammonium in the present embodiment) having a high purity by evaporating the aqueous solution from which impurities have been removed in advance.

As shown in FIG. 9, the impurity removing tank 30 is provided at the pipe 25. In the impurity removing tank 30, sodium chlorate and sodium perchlorate are crystallized and separated under a temperature condition, in which a perchlorate is not decomposed, using the solubility characteristics shown in FIG. 11. The temperature condition is desirably 50° C. or lower, considering the decomposition of a perchlorate. Furthermore, the temperature condition is desirably 20° C. or higher, considering the separation rate. Therefore, as the actual process of the impurity removing process S5, the evaporation and concentration process and the cooling and crystallization process are performed in the impurity removing tank 30.

Fourth Embodiment

Next, a fourth embodiment of the invention will be described with reference to FIGS. 12 and 13. The fourth embodiment is provided with the following configuration in order to increase the purity of the synthesized ammonium perchlorate to higher than the third embodiment.

Figure 12:
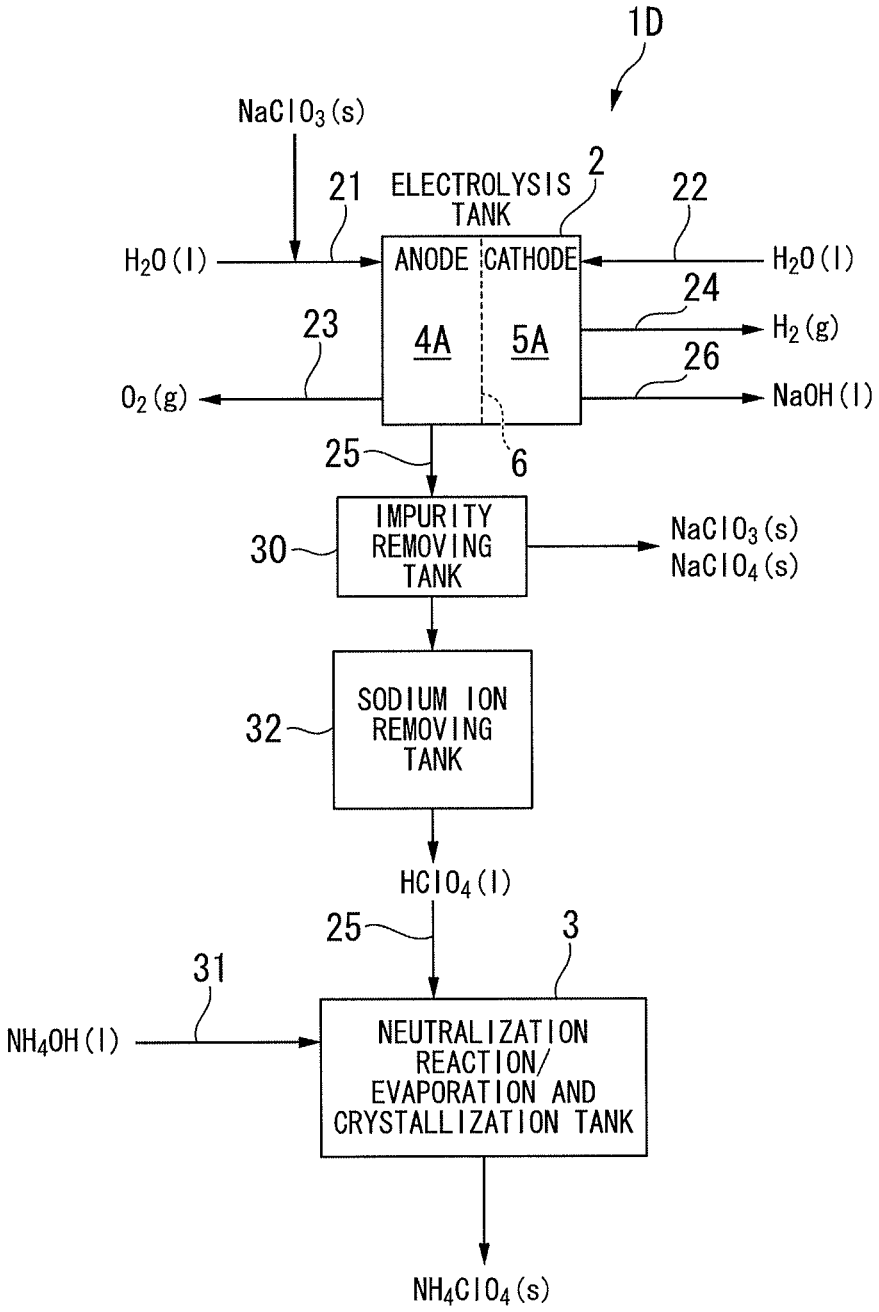
FIG. 12 is a schematic configuration view of an apparatus for manufacturing ammonium perchlorate according to a fourth embodiment of the invention.
Figure 13:
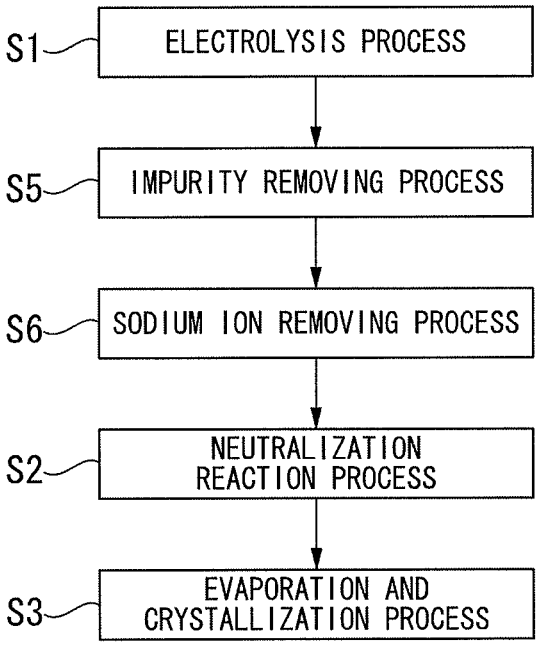
FIG. 13 is a flow chart of a process of manufacturing ammonium perchlorate according to the fourth embodiment of the invention.

FIG. 12 is a schematic configuration view of an apparatus 1D of manufacturing ammonium perchlorate according to the fourth embodiment of the invention. FIG. 13 is a flow chart of a process of manufacturing ammonium perchlorate according to the fourth embodiment. The apparatus 1D of manufacturing ammonium perchlorate according to the fourth embodiment is provided with a sodium ion removing tank (a cation exchange tank) 32 filled with a hydrogen ion-type ion-exchange resin that substitutes sodium ions with hydrogen ions between the impurity removing tank 30 and the neutralization reaction/evaporation and crystallization tank 3. Here, as the hydrogen ion-type ion-exchange resin, for example, Diaion (manufactured by Mitsubishi Chemical Corporation, registered trade mark) is used.

In the fourth embodiment, the sodium ion removing tank 32 is provided between the impurity removing tank 30 and the neutralization reaction/evaporation and crystallization tank 3, and sodium ions remaining in the solution which have undergone the impurity removing process S5 are substituted with hydrogen ions (a sodium ion removing process S6). Thereby, it is possible to easily obtain the crystals of ammonium perchlorate having a high purity in the neutralization reaction/evaporation and crystallization tank 3.

Fifth Embodiment

Next, a fifth embodiment of the invention will be described with reference to FIGS. 14 to 16. The fifth embodiment is provided with the following configuration in order to refine the grain size of the crystals of the synthesized ammonium perchlorate.

Figure 14:
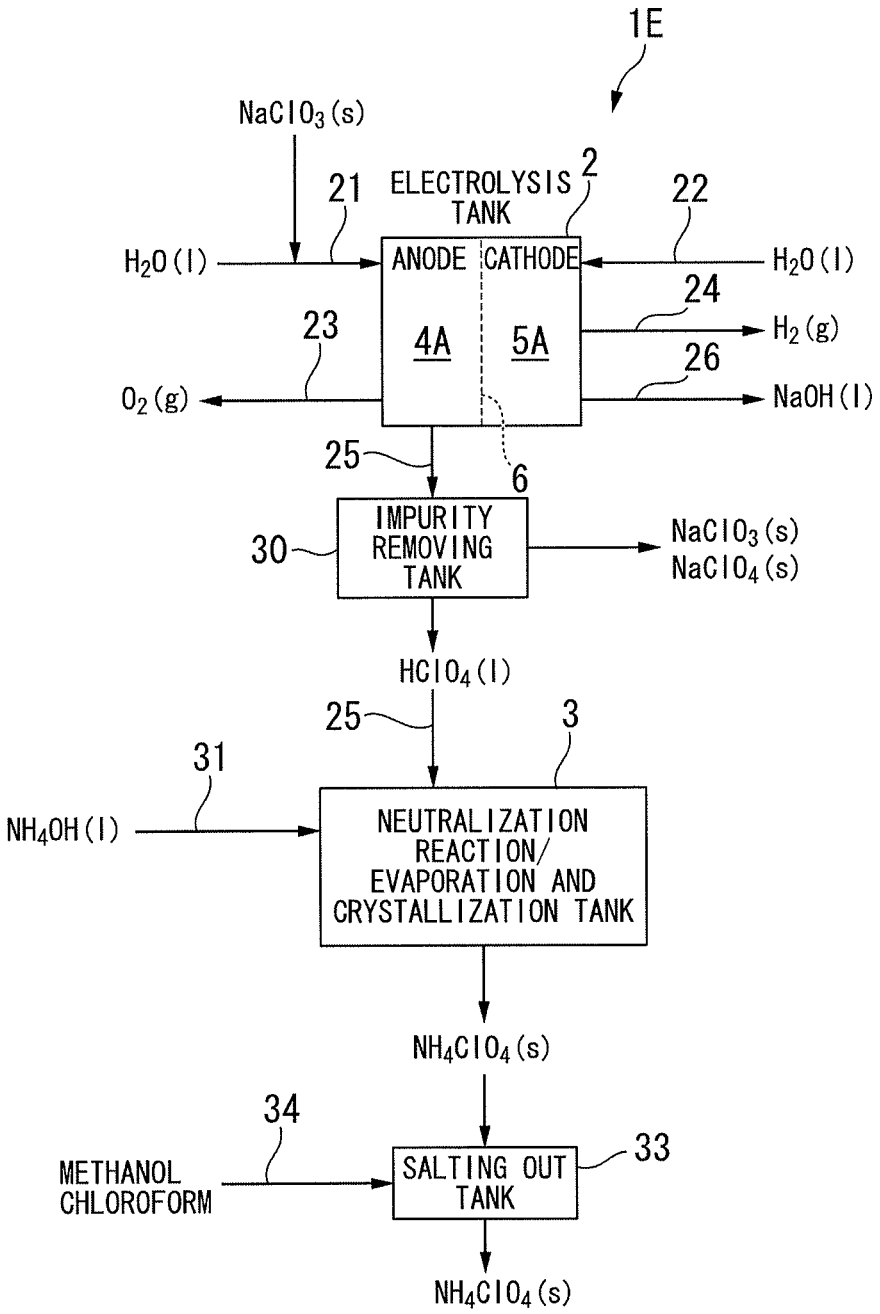
FIG. 14 is a schematic configuration view of an apparatus for manufacturing ammonium perchlorate according to a fifth embodiment of the invention.
Figure 15:
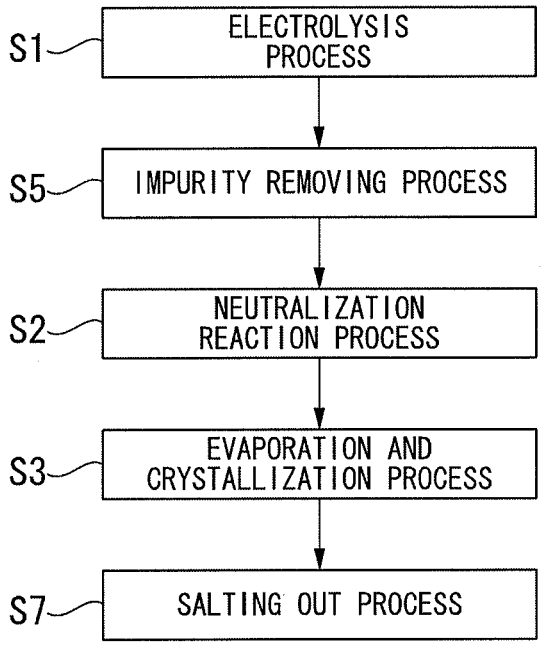
FIG. 15 is a flow chart of a process of manufacturing ammonium perchlorate according to the fifth embodiment of the invention.

FIG. 14 is a schematic configuration view of an apparatus 1E of manufacturing ammonium perchlorate according to the fifth embodiment of the invention. FIG. 15 is a flow chart of a process of manufacturing ammonium perchlorate according to the fifth embodiment. The apparatus 1E of manufacturing ammonium perchlorate according to the fifth embodiment is provided with a salting out tank 33 after the neutralization reaction/evaporation and crystallization tank 3. Here, the salting-out tank 33 is filled with methanol in advance, in which ammonium perchlorate obtained through the neutralization reaction process S2 and the evaporation and crystallization process S3 is dissolved in the methanol. After that, chloroform is added to the methanol as a precipitating agent through a pipe 34, and ammonium perchlorate is crystallized (a salting out process S7). Thereby, it is possible to easily obtain the fine crystals of ammonium perchlorate.

Finally, a test example of the salting out in which the apparatus 1E of manufacturing ammonium perchlorate according to the fifth embodiment is used will be described.

In the present test, firstly, 3 g of the crystals of ammonium perchlorate which have been formed in the neutralization reaction/evaporation and crystallization tank 3 and include developed facets of about 500 μm (see FIG. 4) is dissolved in the salting out tank 33 filled with 67 g of methanol (manufactured by Kanto Chemical Co. Inc., with a purity of 99.0% or higher). Next, 94 g of chloroform (manufactured by Kanto Chemical Co. Inc., with a purity of 99.0% or higher) is added to the methanol solution and is stirred for 30 minutes at a solution temperature of 20° C. Here, when the chloroform is added to the methanol solution, nuclei of ammonium perchlorate are generated, and thus the solution becomes cloudy. After that, the solution having the chloroform added thereto is filtered using a filter so that 1.9 g of ammonium perchlorate is formed. As a result, the yield of ammonium perchlorate becomes 63%.

Figure 16:
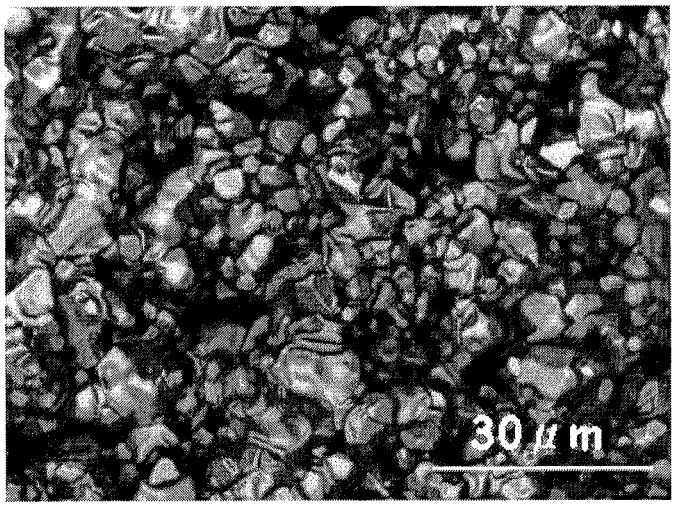
FIG. 16 shows a microscope photograph of the eutectic points of crystals obtained by the apparatus for manufacturing ammonium perchlorate according to the fifth embodiment of the invention.

FIG. 16 shows a microscope photograph of the eutectic points of ammonium perchlorate crystallized by the salting out process S7. The microscope photograph of the eutectic points shows the grain sizes of the crystals of the salted-out ammonium perchlorate were 5 μm to 15 μm. That is, it was confirmed that, by the fifth embodiment, fine crystals of ammonium perchlorate could be obtained.

Furthermore, a test of salting out ammonium perchlorate was performed under the same test conditions as the above with a substitution of the precipitating agent from chloroform to dichloromethane (manufactured by Kanto Chemical Co. Inc., with a purity of 99.0% or higher). As a result, it was confirmed that the yield of ammonium perchlorate was 37%, and ammonium perchlorate having a grain size of about 5 μm to 15 μm could be obtained similarly to the case in which chloroform was added as the precipitating agent.

In sixth to tenth embodiments, methods and apparatuses of manufacturing lithium perchlorate, which is a perchlorate, will be described.

Sixth Embodiment

Figure 17:
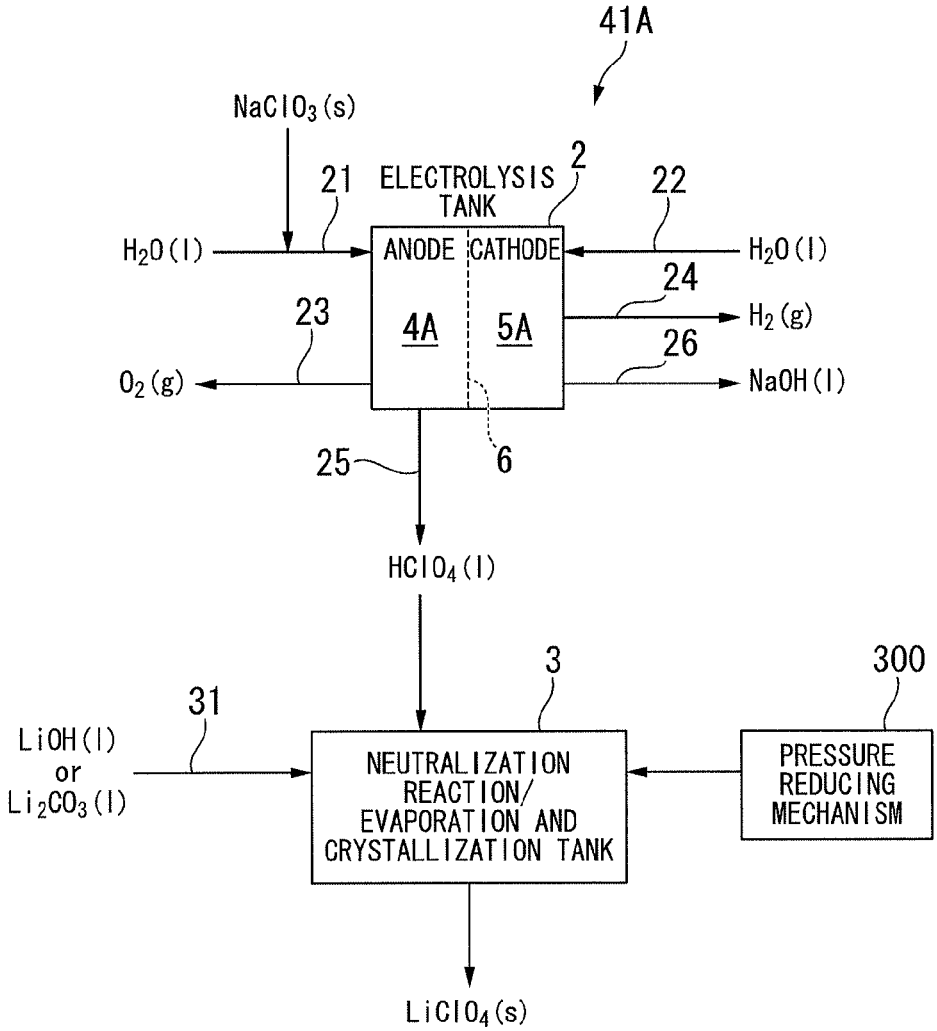
FIG. 17 is a schematic configuration view of an apparatus for manufacturing lithium perchlorate according to a sixth embodiment of the invention.
Figure 18:
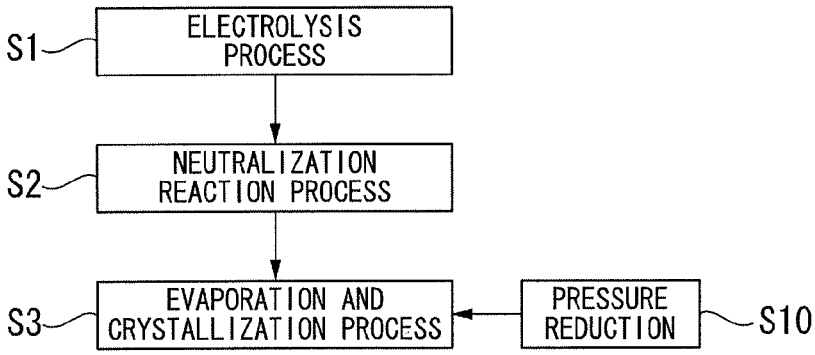
FIG. 18 is a flow chart of a process of manufacturing lithium perchlorate according to the sixth embodiment of the invention.

FIG. 17 is a schematic configuration view of an apparatus 41A of manufacturing lithium perchlorate according to the sixth embodiment of the invention. Here, the signs 'g', 'l', and 's' in the drawing indicate the states of gas, liquid, and solid, respectively. The apparatus 41A of manufacturing lithium perchlorate is provided with the electrolysis tank 2 and the neutralization reaction/evaporation and crystallization tank 3, and the neutralization reaction/evaporation and crystallization tank 3 is provided with a pressure reducing mechanism 300. The pressure reducing mechanism 300 is not limited as long as the mechanism can reduce the pressure in the tank to a vacuum state such as a vacuum pump.

As the electrolysis tank 2 in the sixth embodiment of the invention, the electrolysis tank 2 (FIG. 2) as described in the first embodiment is used. The electrolysis tank 2 has already been described in the first embodiment, and thus will not be described again in the present embodiment. The difference from the first embodiment is that the pressure reducing mechanism 300 is provided in the neutralization reaction/evaporation and crystallization tank 3.

A sufficient amount of perchlorate ions are generated after the chemical equation (5) as described in the first embodiment occurs, voltage is applied, and a predetermined time elapses. After that, the anode fluid is transported to the neutralization reaction/evaporation and crystallization tank 3 provided with the pressure reducing mechanism 300 from the anode section 4A in the electrolysis tank 2 through the pipe 25 shown in FIG. 17. On the other hand, the cathode fluid is transported outside from the cathode section 5A in the electrolysis tank 2 through the pipe 26.

In the neutralization reaction/evaporation and crystallization tank 3, an aqueous solution of lithium hydrate or an aqueous solution of lithium carbonate is added to the electrolytically oxidized anode fluid so as to synthesize lithium perchlorate. The synthesized anode fluid is evaporated under a pressure-reducing environment so that lithium perchlorate is formed into crystals.

A supply pipe 31 is connected to the neutralization reaction/evaporation and crystallization tank 3 of the embodiment, and an aqueous solution of lithium hydrate is added to the electrolytically oxidized anode fluid. When an aqueous solution of lithium hydrate is added to the electrolytically oxidized anode fluid, a reaction shown in the following chemical equation (7) occurs, and lithium perchlorate is synthesized.

$$HClO_4+LiOH \rightarrow LiClO_4+H_2O \quad (7)$$

In addition, when an aqueous solution of lithium carbonate is added to the electrolytically oxidized anode fluid, a reaction shown in the following chemical equation (8) occurs, and lithium perchlorate is synthesized.

$$2HClO_4+Li_2CO_3 \rightarrow 2LiClO_4+H_2O+CO_2 \quad (8)$$

Next, in the neutralization reaction/evaporation and crystallization tank 3, the synthesized anode fluid is evaporated under a pressure reducing environment so as to form the crystals of lithium perchlorate (the evaporation and crystallization process S3). Since perchlorate included in the synthesized anode fluid is decomposed into chlorine when heated to 50° C. or higher, lithium perchlorate is crystallized while no heat is added and the inside of the neutralization reaction/evaporation and crystallization tank 3 is maintained to be vacuum. Since the byproduct obtained together with lithium perchlorate by the process (7) or (8) is water or water and carbon dioxide, it is possible to obtain the crystals of lithium perchlorate with no necessity of separating the byproduct, such as sodium sulfate, using a filter, unlike the related art.

Furthermore, since the effect of the sixth embodiment is the same as the effect of the first embodiment, and thus will not be described again.

In addition, in the sixth embodiment, a process is provided in which an aqueous solution of lithium hydrate or an aqueous solution of lithium carbonate is added to the electrolytically oxidized anode fluid in the anode section 4A so that lithium perchlorate is synthesized by a neutralization reaction. Here, since, sodium ions are separated from the anode solution in the process (7) or (8), and the byproduct generated by the reaction is water, or water and carbon dioxide, it is not necessary to separate the byproduct, such as sodium chloride, which was required in the metathetical method of the related art. Therefore, it becomes possible to achieve simplification of the process of manufacturing lithium perchlorate.

Subsequently, an example of a test in which the apparatus 41A of manufacturing lithium perchlorate in the above configuration is used will be described.

In the present test, firstly, the electrolytic oxidation of an aqueous solution of sodium chlorate was performed in the electrolysis tank 2. Subsequently, the electrolyzed anode fluid was moved from the anode section 4A in the electrolysis tank 2 to the neutralization reaction/evaporation and crystallization tank 3 through the pipe 25, and an aqueous solution of lithium hydrate or an aqueous solution of lithium carbonate was added to the anode fluid, thereby neutralizing the anode fluid. Finally, the neutralized aqueous solution was evaporated under a pressure-reducing environment so as to form crystals. Hereinafter, since the details of each of the processes are the same as those as described in the first embodiment, the processes through the neutralization reaction process will not be described.

Figure 19:
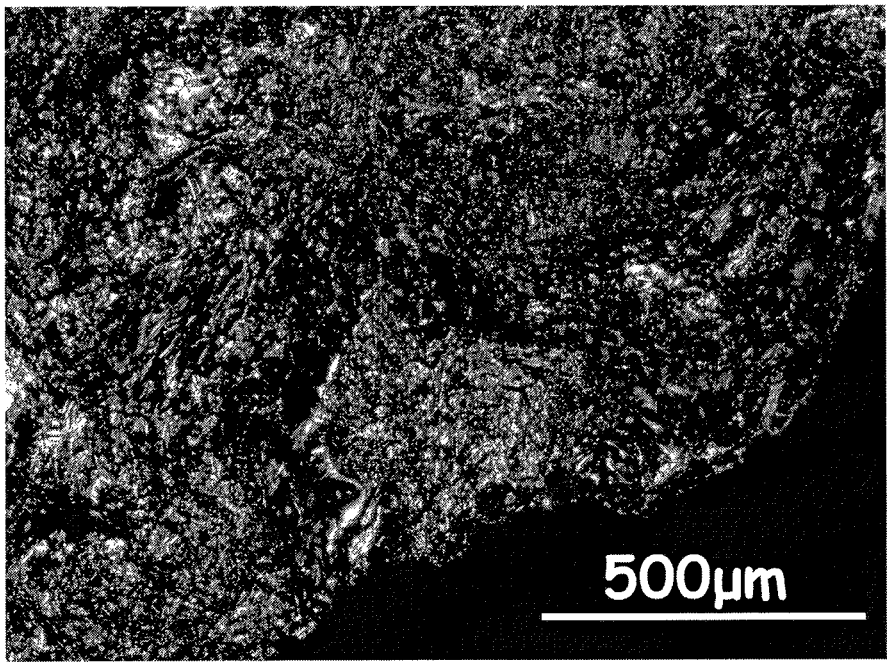
FIG. 19 shows a microscope photograph of the eutectic points of crystals obtained by the apparatus for manufacturing lithium perchlorate according to the sixth embodiment of the invention.

The electrolytically oxidized anode fluid was moved from the anode section 4A in the electrolysis tank 2 to the neutralization reaction/evaporation and crystallization tank 3 through the pipe 25, and an aqueous solution of lithium hydrate or an aqueous solution of lithium carbonate was added to the anode fluid, thereby neutralizing the anode fluid. After that, the neutralized anode fluid was evaporated at 20° C. in a pressure-reducing environment. FIG. 19 shows a microscope photograph of the eutectic points of grains crystallized by the evaporation and crystallization process S3 in the pressure reducing environment.

Figure 20:
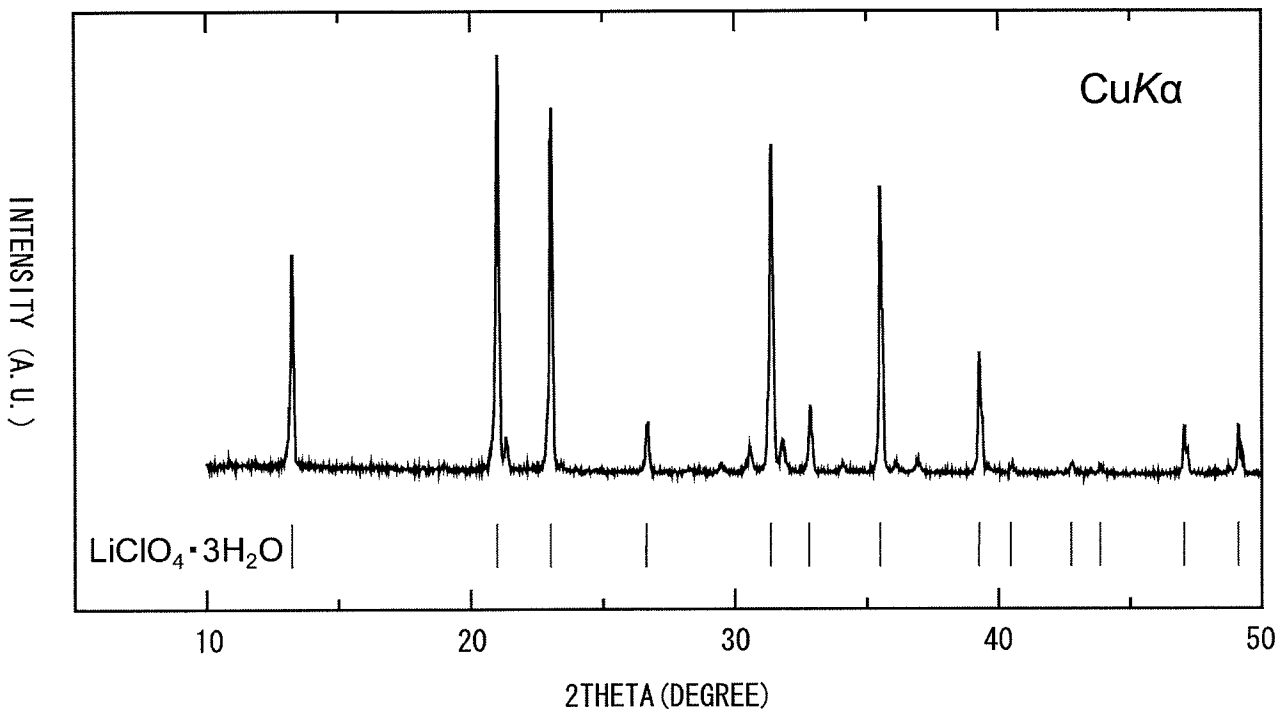
FIG. 20 shows a powder X-ray diffraction spectrum of the crystals obtained by the apparatus for manufacturing lithium perchlorate according to the sixth embodiment of the invention. Here, as a neutralizing agent of the aqueous solution of perchloric acid generated by the electrolytic oxidation of the aqueous solution of sodium chlorate, an aqueous solution of lithium hydroxide was used.

FIG. 20 shows a powder X-ray diffraction spectrum of the crystals obtained when an aqueous solution of lithium hydrate is added as a neutralizing agent of the aqueous solution of perchloric acid which has been generated by the electrolytic oxidation. In the drawing, the vertical axis indicates the diffraction intensity normalized by the highest X-ray diffraction intensity, and the horizontal axis indicates a diffraction angle of 2θ.

As shown in FIG. 20, the diffraction rays of the crystals obtained in the test matched the diffraction rays (discrete solid lines) of the standard specimen of lithium perchlorate trihydrate ($LiClO_4.3H_2O$). That is, it was confirmed that the crystals of lithium perchlorate trihydrate were generated by the sixth embodiment.

Figure 21:
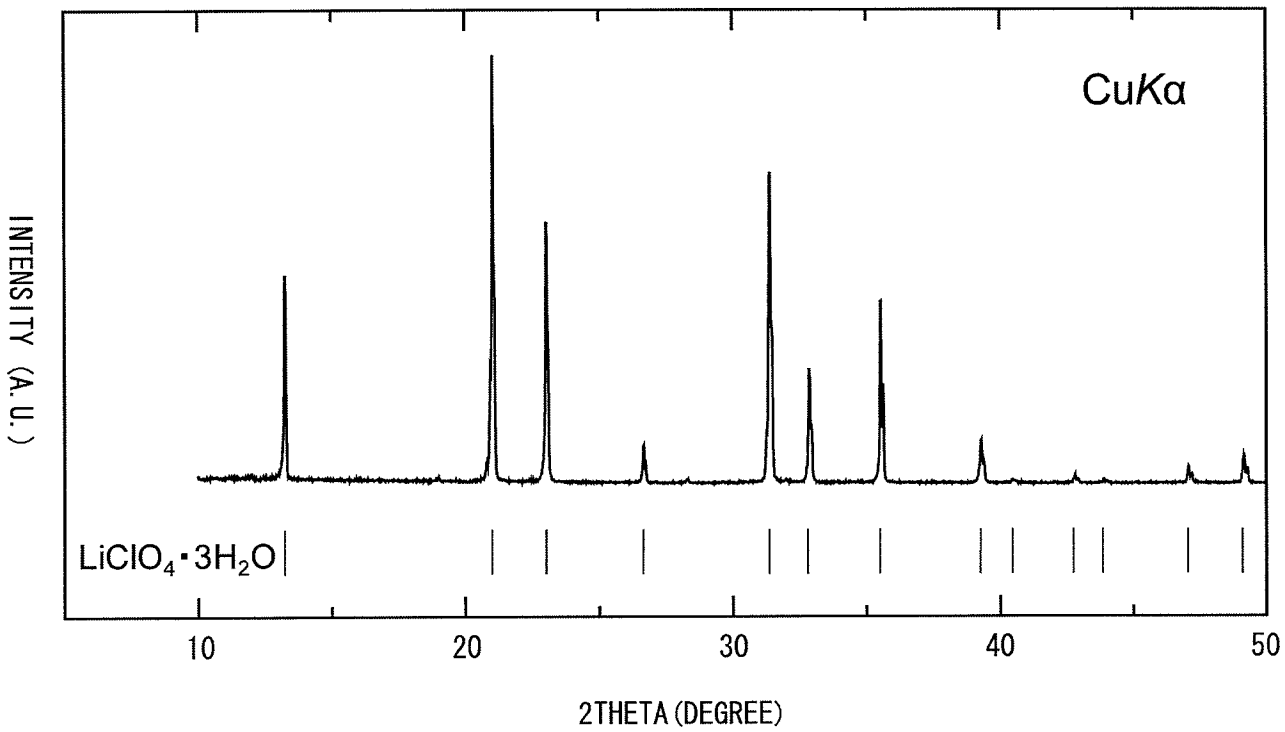
FIG. 21 shows a powder X-ray diffraction spectrum of the crystals obtained by the apparatus for manufacturing lithium perchlorate according to the sixth embodiment of the invention. Here, as a neutralizing agent of the aqueous solution of perchloric acid generated by the electrolytic oxidation of the aqueous solution of sodium chlorate, an aqueous solution of lithium carbonate was used.

FIG. 21 shows a powder X-ray diffraction spectrum of the crystals obtained when an aqueous solution of lithium carbonate is added as a neutralizing agent of the aqueous solution of perchloric acid which has been generated by the electrolytic oxidation. Similarly to the case in which an aqueous solution of lithium hydrate is added as a neutralizing agent, since the diffraction rays of the crystals obtained in the test matched the diffraction rays (discrete solid lines) of the standard specimen of lithium perchlorate trihydrate ($LiClO_4.3H_2O$), it was confirmed that the crystals were lithium perchlorate trihydrate ($LiClO_4.3H_2O$).

Seventh Embodiment

Subsequently, a seventh embodiment of the invention will be described with reference to FIGS. 22 and 23.

Figure 22:
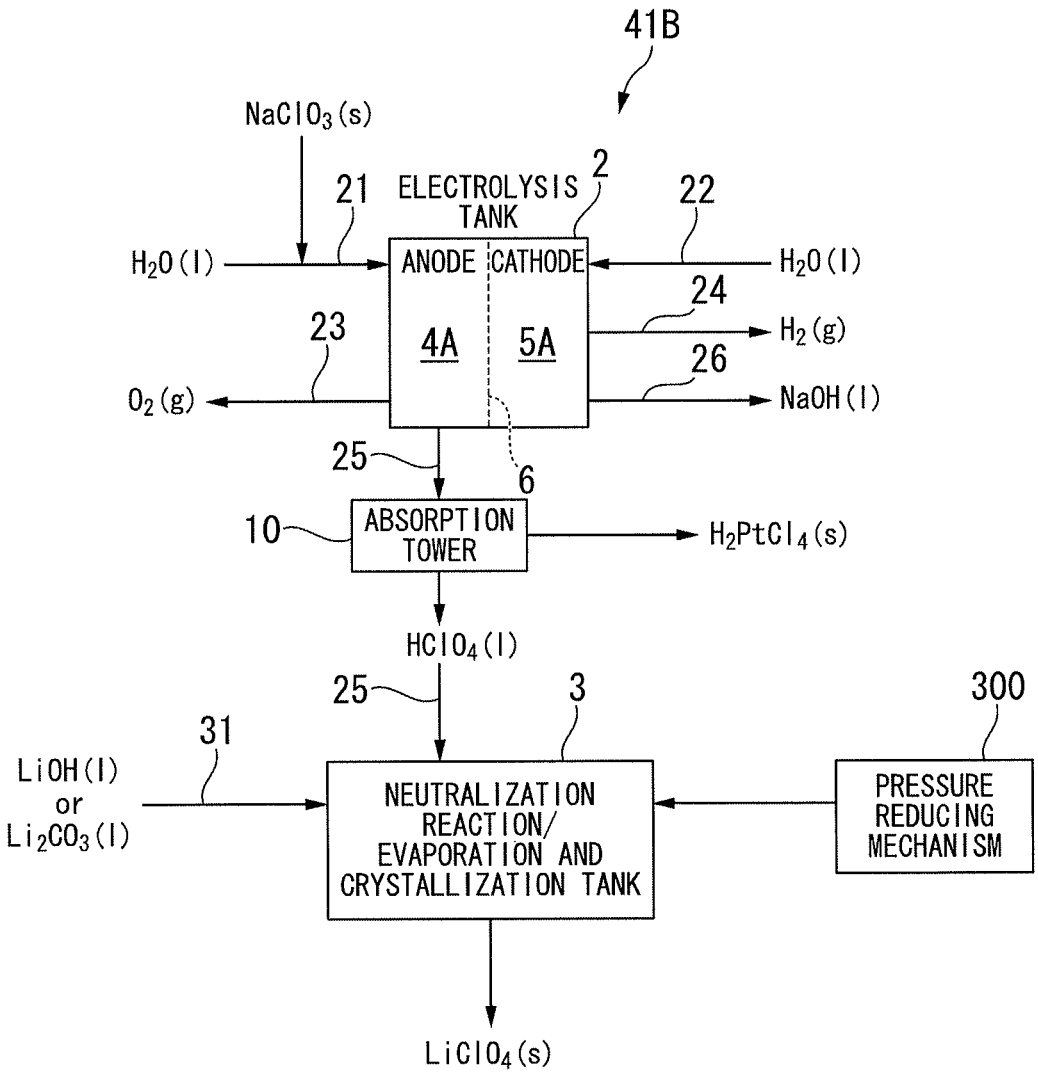
FIG. 22 is a schematic configuration view of an apparatus for manufacturing lithium perchlorate according to a seventh embodiment of the invention.
Figure 23:
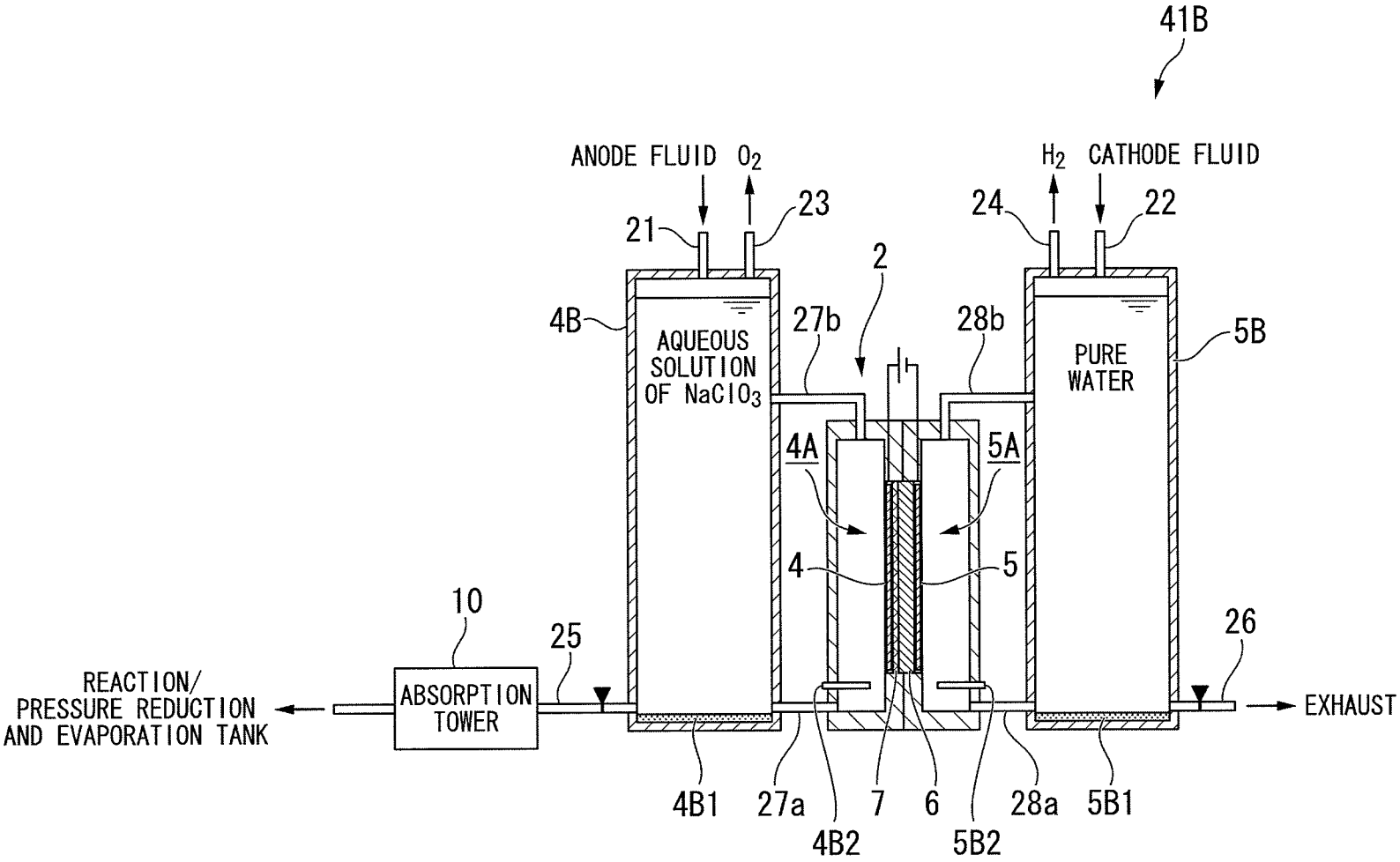
FIG. 23 is a configuration view of an apparatus for manufacturing lithium perchlorate according to the seventh embodiment of the invention.

FIG. 22 is a schematic configuration view of an apparatus 41B of manufacturing lithium perchlorate according to the seventh embodiment of the invention.

Furthermore, since the flow charts of the seventh to tenth embodiments are the same as the flow charts of the second to fifth embodiments except that a pressure reducing process is added, the flow charts of the seventh to tenth embodiments will not be described.

FIG. 22 is a configuration view of the apparatus 41B of manufacturing lithium perchlorate according to the seventh embodiment of the invention.

As described in FIG. 22, the apparatus 41B of manufacturing lithium perchlorate according to the seventh embodiment is different from the sixth embodiment in that the absorption tower 10 is provided between the electrolysis tank 2 and the neutralization reaction/evaporation and crystallization tank 3 provided with the pressure reducing mechanism 300 that absorbs platinum which is dissolved in the anode fluid by the electrolytical oxidation. In addition, as shown in FIG. 23, the apparatus 41B of manufacturing lithium perchlorate according to the seventh embodiment is provided with the anode fluid tank 4B and the cathode fluid tank 5B. Furthermore, the apparatus 41B of manufacturing lithium perchlorate has the same configuration as the apparatus 1B of manufacturing ammonium perchlorate except that the pressure reducing mechanism 300 is provided in the neutralization reaction/evaporation and crystallization tank 3 in comparison to the apparatus 1B of manufacturing ammonium perchlorate as described in the second embodiment. Therefore, the details of the configuration and effects of the apparatus 41B of manufacturing lithium perchlorate according to the seventh embodiment are the same as the second embodiment, and thus will not be described again.

Eighth Embodiment

Next, an eighth embodiment of the invention will be described with reference to FIGS. 24 to 11. The eighth embodiment is provided with the following configuration in order to increase the purity of the crystals of the synthesized lithium perchlorate.

Figure 24:
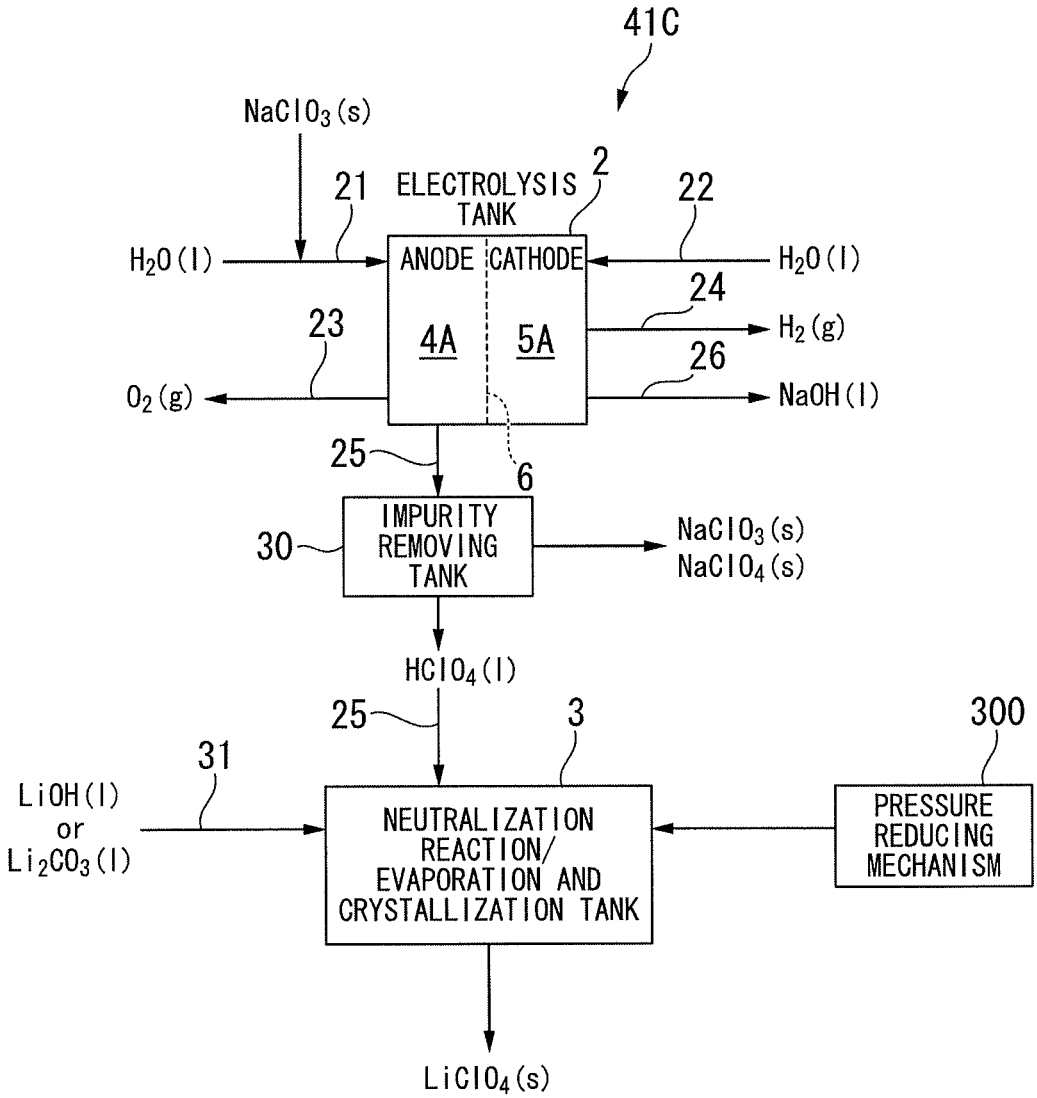
FIG. 24 is a schematic configuration view of an apparatus for manufacturing lithium perchlorate according to an eighth embodiment of the invention.

FIG. 24 is a schematic configuration view of an apparatus 41C of manufacturing lithium perchlorate according to the eighth embodiment. The apparatus 41C of manufacturing lithium perchlorate according to the eighth embodiment is provided with the impurity removing tank 30 between the electrolysis tank 2 and the neutralization reaction/evaporation and crystallization tank 3 provided with the pressure reducing mechanism 300 that separates sodium chlorate and sodium perchlorate remaining in the anode fluid which has undergone the electrolytic oxidation. Furthermore, the apparatus 41C of manufacturing lithium perchlorate has the same configuration and effects as the apparatus 1C of manufacturing ammonium perchlorate except that the pressure reducing mechanism 300 is provided in the neutralization reaction/evaporation and crystallization tank 3 in comparison to the apparatus 1C of manufacturing ammonium perchlorate as described in the third embodiment, and thus will not be described again. However, unlike the apparatus 1C of manufacturing ammonium perchlorate, in the apparatus 41C of manufacturing lithium perchlorate, the synthesized anode fluid is evaporated under a pressure reducing environment in the neutralization reaction/evaporation and crystallization tank 3 provided with the pressure reducing mechanism 300 so as to form the crystals of lithium perchlorate.

As shown in FIG. 24, the impurity removing tank 30 is provided at the pipe 25. In the impurity removing tank 30, sodium chlorate and sodium perchlorate are crystallized and separated under a temperature condition, in which perchlorate is not decomposed, using the solubility characteristics shown in FIG. 11. The temperature condition is desirably 50° C. or lower, considering the decomposition of perchlorate. Furthermore, the temperature condition is desirably 20° C. or higher, and the pressure in the impurity removing tank 30 is preferably atmospheric or lower, considering the separation rate. Meanwhile, since the separated sodium chlorate and sodium perchlorate are introduced to the anode section 4A in the electrolysis tank 2 as a part of the raw material of perchlorate, it is possible to contribute to the reduction of the costs for raw materials.

Ninth Embodiment

Next, a ninth embodiment of the invention will be described with reference to FIG. 25. The ninth embodiment is provided with the following configuration in order to increase the purity of the crystals of the synthesized lithium perchlorate to higher than the eighth embodiment.

Figure 25:
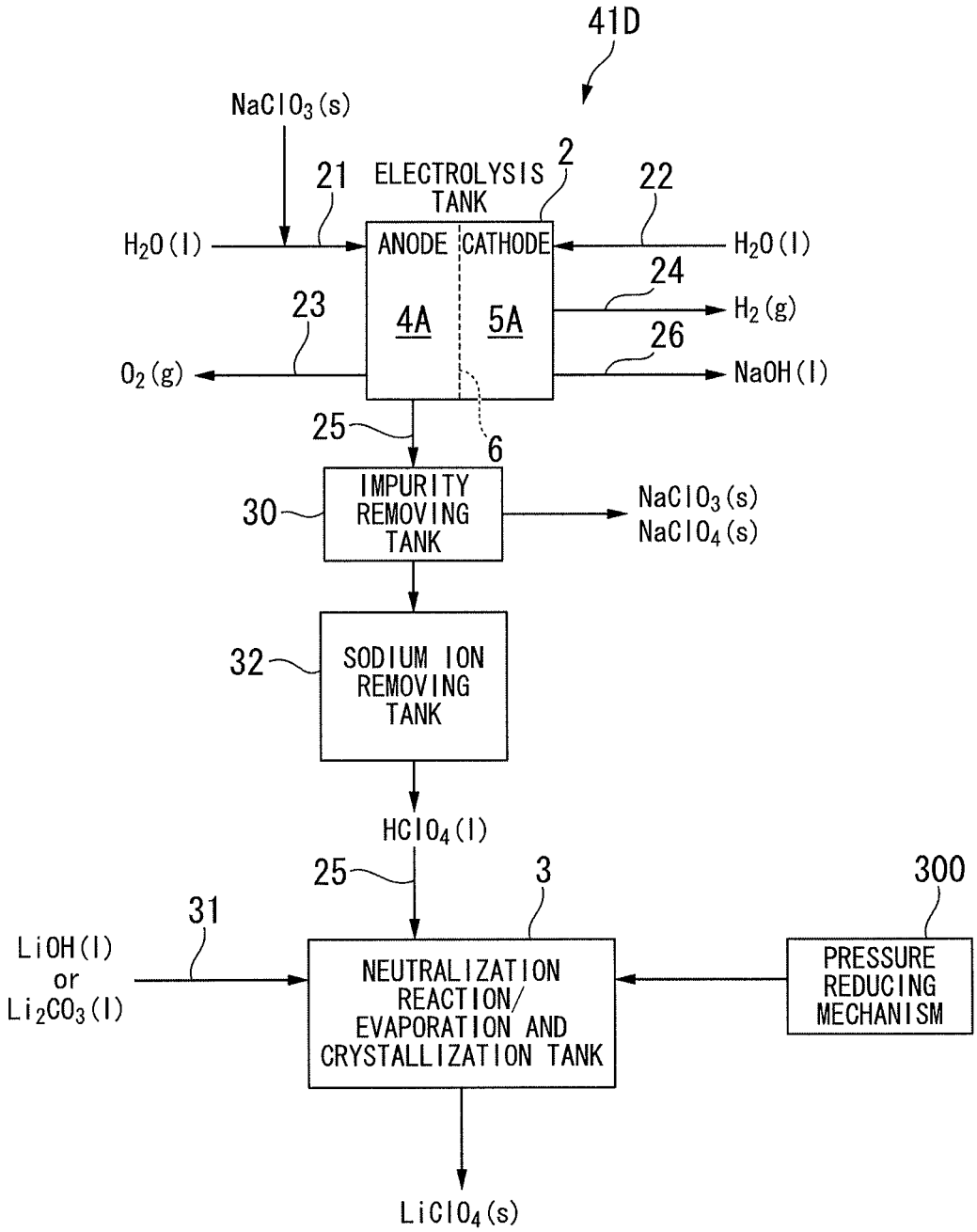
FIG. 25 is a schematic configuration view of an apparatus for manufacturing lithium perchlorate according to a ninth embodiment of the invention.

FIG. 25 is a schematic configuration view of an apparatus 41D of manufacturing lithium perchlorate according to the ninth embodiment of the invention. The apparatus 41D of manufacturing lithium perchlorate according to the ninth embodiment is provided with a sodium ion removing tank 32 filled with a hydrogen ion-type ion-exchange resin that substitutes sodium ions with hydrogen ions between the impurity removing tank 30 and the neutralization reaction/evaporation and crystallization tank 3 provided with the pressure reducing mechanism 300. Here, as the hydrogen ion-type ion-exchange resin, for example, Diaion (manufactured by Mitsubishi Chemical Corporation, registered trade mark) is used. Furthermore, this configuration has the same configuration and effects as the apparatus 1C of manufacturing ammonium perchlorate (the fourth embodiment) except that the neutralization reaction/evaporation and crystallization tank 3 is provided with the pressure reducing mechanism 300 in comparison to the apparatus 1D of manufacturing ammonium perchlorate as described in the fourth embodiment.

In the ninth embodiment, the sodium ion removing tank 32 is provided between the impurity removing tank 30 and the neutralization reaction/evaporation and crystallization tank 3 provided with the pressure reducing mechanism 300, and sodium ions remaining in the solution which have undergone the impurity removing process S5 are substituted with hydrogen ions (the sodium ion removing process S6). Thereby, it is possible to easily obtain the crystals of lithium perchlorate having a high purity in the neutralization reaction/evaporation and crystallization tank 3 provided with the pressure reducing mechanism 300.

Tenth Embodiment

Next, a tenth embodiment of the invention will be described with reference to FIGS. 26 to 28. In the tenth embodiment, a method and an apparatus for manufacturing potassium perchlorate, which is an alkaline metal perchlorate, will be described.

Figure 26:
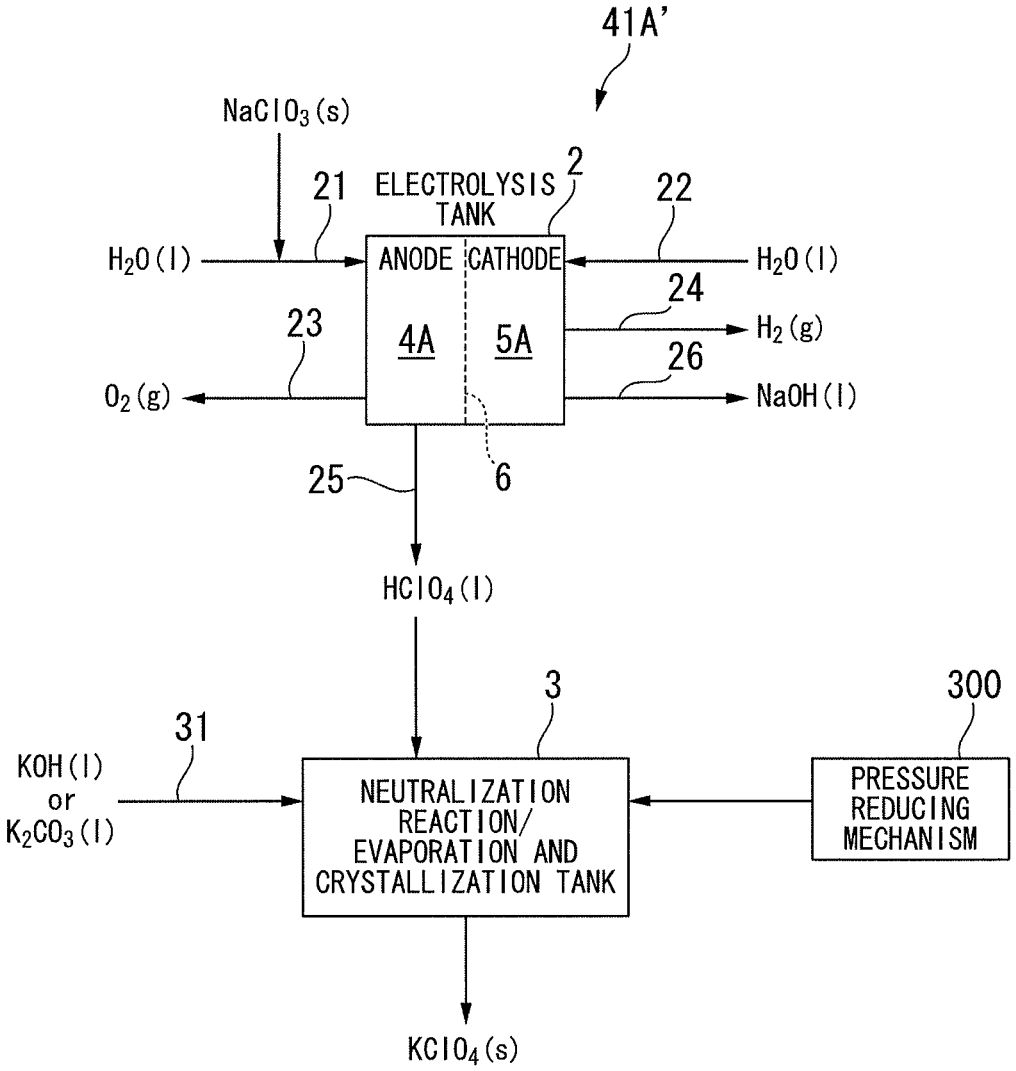
FIG. 26 is a schematic configuration view of an apparatus for manufacturing potassium perchlorate according to a tenth embodiment of the invention.

FIG. 26 is a schematic configuration view of an apparatus 41A' of manufacturing potassium perchlorate according to the tenth embodiment. The apparatus 41A' of manufacturing potassium perchlorate is provided with the electrolysis tank 2 and the neutralization reaction/evaporation and crystallization tank 3 provided with the pressure reducing mechanism 300. Meanwhile, portions having the same configuration as the above embodiments will be given the same reference numerals, and will not be described again in detail. In addition, since the processes through the process in which electrolytic oxidation is performed in the electrolysis tank 2 are the same as the above embodiments, the processes will not be described again.

In the neutralization reaction/evaporation and crystallization tank 3 provided with the pressure reducing mechanism 300 in the apparatus 41A' of manufacturing potassium perchlorate, potassium hydrate or potassium carbonate is added to the anode fluid, which has been electrolytically oxidized in the electrolysis tank 2, so as to synthesize potassium perchlorate by a neutralization reaction. The synthesized anode fluid is evaporated under a pressure-reducing environment so that potassium perchlorate is formed into crystals.

A supply pipe 31 is connected to the neutralization reaction/evaporation and crystallization tank 3 of the embodiment, which is provided with the pressure reducing mechanism 300, and an aqueous solution in which potassium hydrate is dissolved in the electrolytically oxidized anode fluid or an aqueous solution in which potassium carbonate is dissolved in the electrolytically oxidized anode fluid is added to the electrolytically oxidized anode fluid. When an aqueous solution of potassium hydrate is added to the electrolytically oxidized anode fluid, a neutralization reaction shown in the following chemical equation (9) occurs, and potassium perchlorate is synthesized.

$$HClO_4+KOH \rightarrow KClO_4+H_2O \quad (9)$$

In addition, when an aqueous solution of potassium carbonate is added to the electrolytically oxidized anode fluid, a neutralization reaction shown in the following chemical equation (10) occurs, and potassium perchlorate is synthesized.

$$2HClO_4K_2CO_3 \rightarrow 2KClO_4+H_2O+CO_2 \quad (10)$$

Next, in the neutralization reaction/evaporation and crystallization tank 3 provided with the pressure reducing mechanism 300, the synthesized anode fluid is evaporated under a pressure reducing environment so as to form the crystals of potassium perchlorate. Since the byproduct obtained together with potassium perchlorate by the process (9) or (10) is water or water and carbon dioxide, it is possible to obtain the crystals of potassium perchlorate with no necessity of separating the byproduct of sodium chloride using a filter, unlike the related art.

Figure 27:
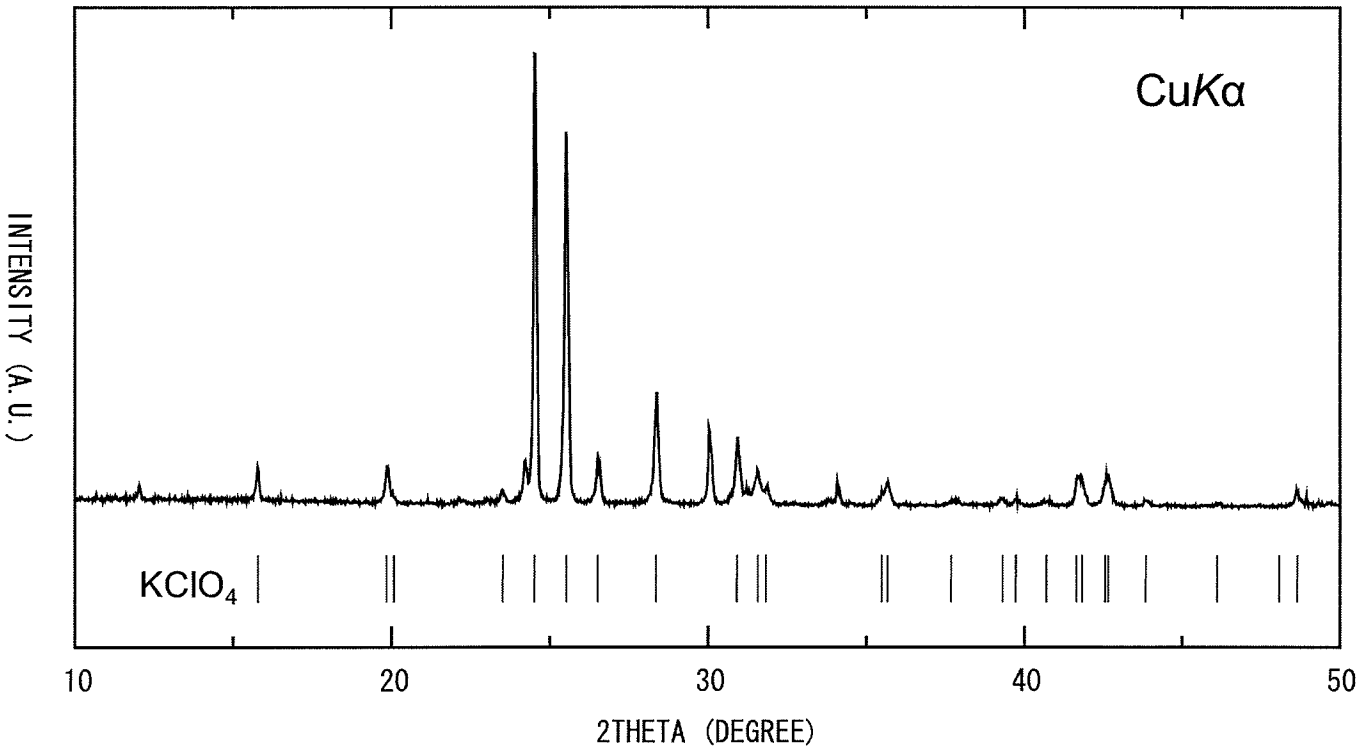
FIG. 27 shows a powder X-ray diffraction spectrum of crystals obtained by the apparatus for manufacturing potassium perchlorate according to the tenth embodiment of the invention. Here, as a neutralizing agent of the aqueous solution of perchloric acid generated by the electrolytic oxidation of the aqueous solution of sodium chlorate, an aqueous solution of potassium hydroxide was used.

FIG. 27 shows a powder X-ray diffraction spectrum of crystals obtained when an aqueous solution of potassium hydrate is used as a neutralizing agent. In the drawing, the vertical axis indicates the diffraction intensity normalized by the highest X-ray diffraction intensity, and the horizontal axis indicates a diffraction angle of 2θ.

As shown in FIG. 27, the diffraction rays of the crystals obtained in the test matched the diffraction rays (discrete solid lines) of the standard specimen of potassium perchlorate. That is, it was confirmed that the crystals of potassium perchlorate ($KClO_4$) were generated.

Figure 28:
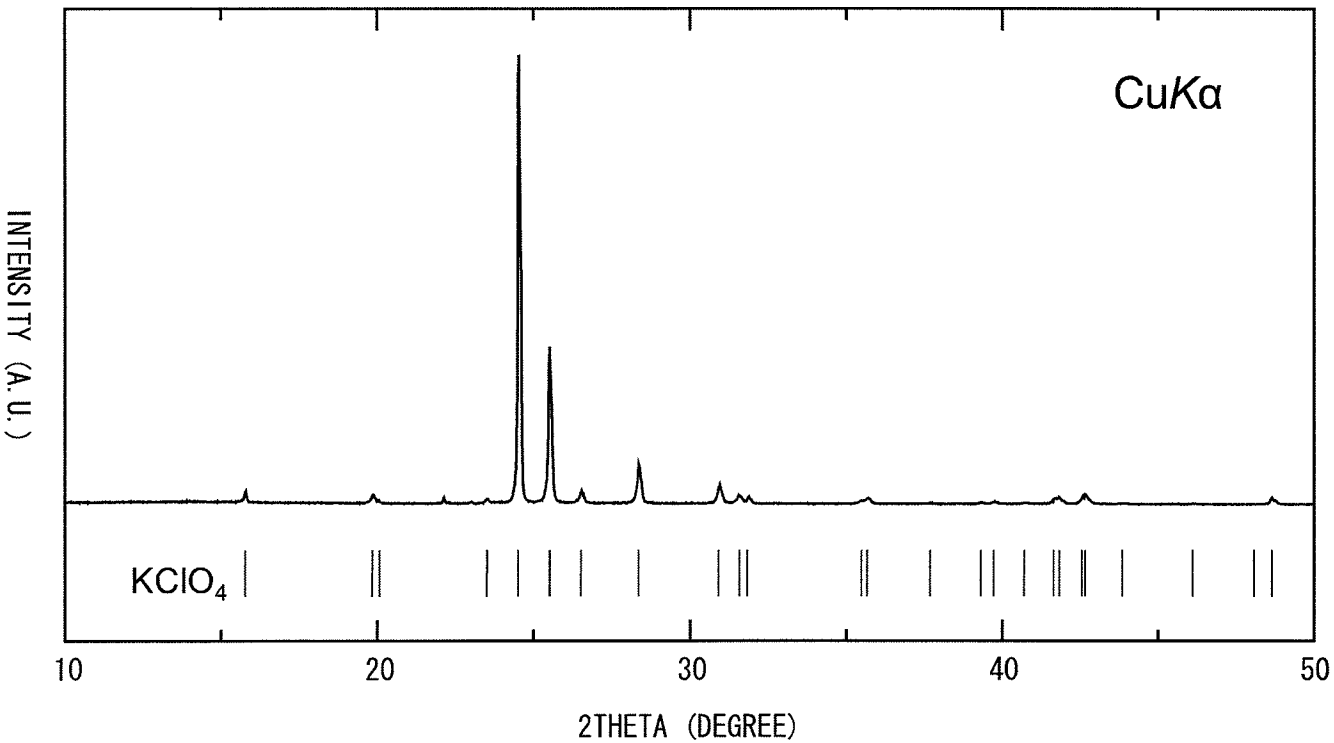
FIG. 28 shows a powder X-ray diffraction spectrum of the crystals obtained by the apparatus for manufacturing potassium perchlorate according to the tenth embodiment of the invention. Here, as a neutralizing agent of the aqueous solution of perchloric acid generated by the electrolytic oxidation of the aqueous solution of sodium chlorate, an aqueous solution of potassium carbonate was used.
Figure 29:
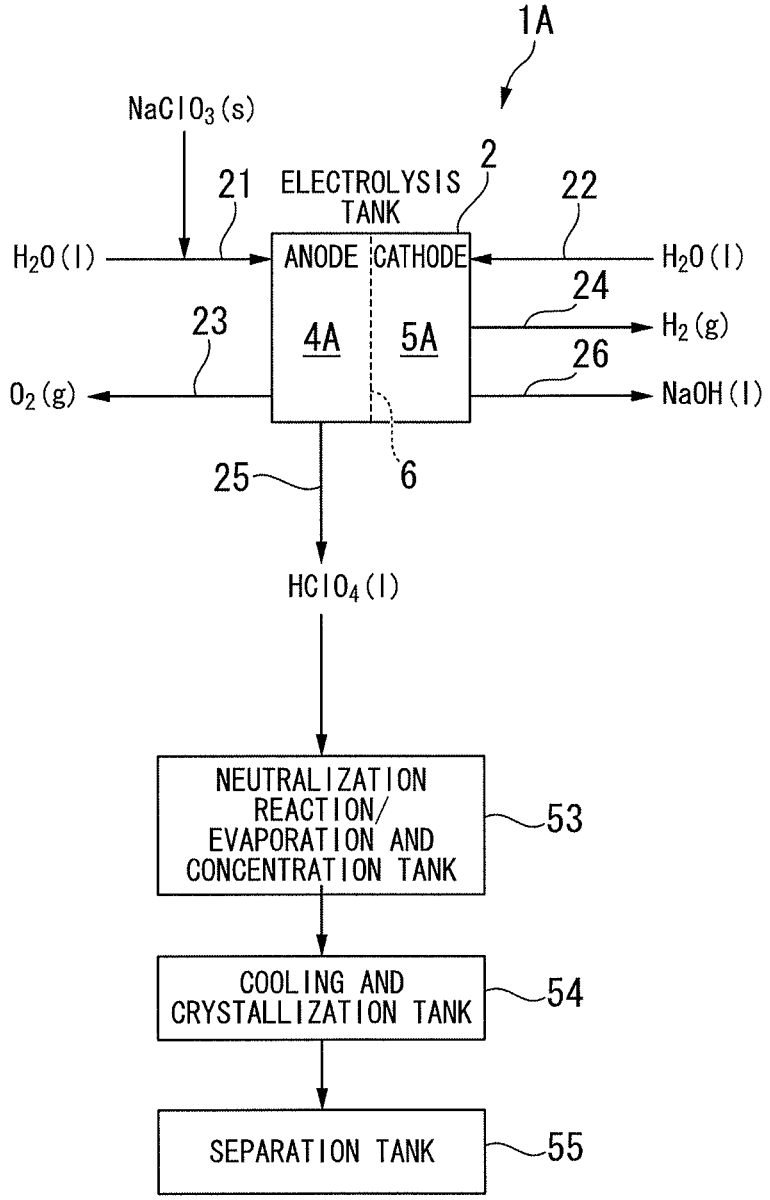
FIG. 29 is a schematic configuration view of an apparatus for manufacturing a perchlorate according to an eleventh embodiment of the invention.
Figure 30:
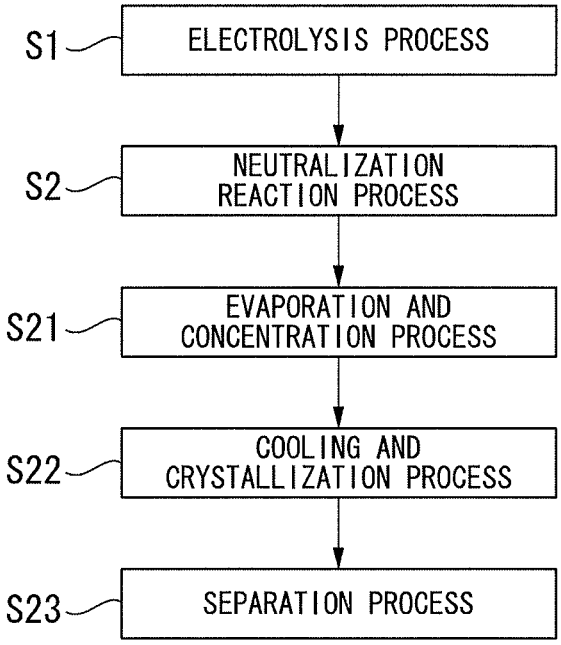
FIG. 30 is a flow chart of a process of manufacturing a perchlorate according to the eleventh embodiment of the invention.

FIG. 28 shows a powder X-ray diffraction spectrum of the crystals obtained when an aqueous solution of potassium carbonate was used as a neutralizing agent. Similarly to the case in which the aqueous solution of potassium hydrate was added as a neutralizing agent, the diffraction rays of the crystals obtained in the test matched the diffraction rays (discrete solid lines) of the standard specimen of potassium perchlorate, and therefore it was confirmed that the crystals were potassium perchlorate ($KClO_4$).

Eleventh Embodiment

Next, an eleventh embodiment of the invention will be described with reference to FIGS. 29 to 32. In the eleventh embodiment, the method of forming crystals from an aqueous solution of a perchlorate synthesized by a neutralization reaction is different from the crystallization method as described in the above embodiments in order to further increase the purity of the crystals of perchlorate. In the evaporation and crystallization process S3 of the above embodiments, the aqueous solution of perchloric acid, which has been synthesized under the atmospheric the environment, is heated and thus fully evaporated (an evaporation and crystallization method). However, in the present embodiment, an aqueous solution of perchloric acid, which has been synthesized by a neutralization reaction, is heated under the atmospheric environment so that a part of the aqueous solution is evaporated and thus concentrated (an evaporation and concentration process S21), and, subsequently, the high temperature concentrated aqueous solution is cooled, thereby crystallizing perchlorate (a cooling and crystallization process S22) (a cooling and crystallization method). Here, the embodiment includes a separation process S23 in which the formed crystals are separated from the concentrated solution.

In addition, the apparatus for manufacturing a perchlorate according to the embodiment includes an evaporation and concentration tank 53 in which perchlorate which has been synthesized in the neutralization reaction tank is concentrated, a cooling and crystallization tank 54 in which perchlorate is formed into crystals from the concentrated solution, and a separation tank 55 in which the formed crystals are separated from the concentrated solution. When the cooling and crystallization method is used, it is possible to perform the neutralization reaction process S2 and the evaporation and concentration process S21 in one tank. The evaporation and concentration process S21 may be performed in the neutralization reaction tank without including the neutralization reaction/evaporation and concentration tank 53, the cooling and crystallization tank 54, and the separation tank 55 separately in the apparatus.

In addition, the separation process S23 may be performed by a variety of known methods, such as a filter press method.

In addition, when it is necessary to further remove moisture attached to the separated crystals, the moisture may be removed using a centrifugal separator or the like. That is, the dehydration process may be performed after the separation process.

Meanwhile, the evaporation and concentration process S21 does not necessarily need to be performed under the atmospheric environment, and may be performed under a vacuum environment using a rotary pump or the like. Thereby, it becomes possible to accelerate the evaporation and concentration of the aqueous solution of perchloric acid, which has been synthesized by the neutralization reaction.

In order to increase the purity of the crystals of perchlorate, the evaporation and crystallization method includes the impurity removing process S5 between the electrolysis process S1 and the neutralization reaction process S2 that crystallizes and thus separates sodium ions and perchlorate ions included in the aqueous solution as sodium chlorate and sodium perchlorate from the aqueous solution of perchloric acid in the anode section, which has been generated by the electrolytic oxidation. As a result, crystals of perchlorate having a high purity can be obtained in the subsequent evaporation and crystallization process S3, but, when the crystallization method of the embodiment is used, it becomes possible to obtain crystals having a high purity without having the impurity removing process S5. Therefore, the present embodiment can be applied to the above first, second, sixth, and seventh embodiments.

Next, an example of a test in which a cooling and crystallization method that is different from the evaporation and crystallization method of the apparatus 1A of manufacturing ammonium perchlorate according to the first embodiment is used will be described hereinafter with reference to FIGS. 29 to 32.

In the present test, firstly, the electrolytic oxidation of an aqueous solution of sodium chlorate was performed in the electrolysis tank 2. Next, the electrolyzed anode fluid was moved from the anode section 4A in the electrolysis tank 2 to the neutralization reaction/evaporation and crystallization tank 53 through the pipe 25. An aqueous solution of ammonia was added to the anode fluid, thereby neutralizing the anode fluid, and the neutralized fluid was maintained at 80° C. so as to be evaporated and concentrated under the atmospheric environment. Finally, the neutralized aqueous solution was stirred and cooled, thereby cooling the concentrated fluid to 20° C. and forming crystals, and then the formed crystals were separated from the concentrated fluid by suction filtration.

Here, when the electrolyzed anode fluid contains sodium ions which have not moved from the anode section to the cathode section through the cation-exchange membrane or a small amount of chlorate ions which have not been converted to perchlorate, these ions come to remain in the filtrate after the suction filtration. Therefore, it is possible to obtain ammonium perchlorate crystals having a high purity by the present method.

Figure 31:
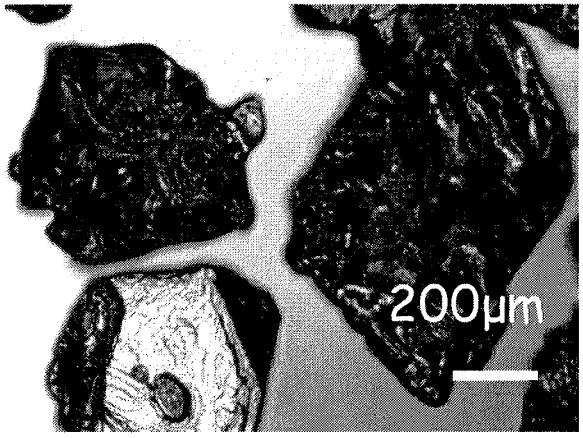
FIG. 31 shows a microscope photograph of the eutectic points of crystals obtained by the apparatus for manufacturing a perchlorate according to the eleventh embodiment of the invention.

FIG. 31 shows a microscope photograph of the eutectic points of crystals obtained by the embodiment. As a result of the microscopic observation, grains having a size of about 100 μm to 500 μm were confirmed. Each particle was an angular particle, similarly to the first embodiment.

Figure 32:
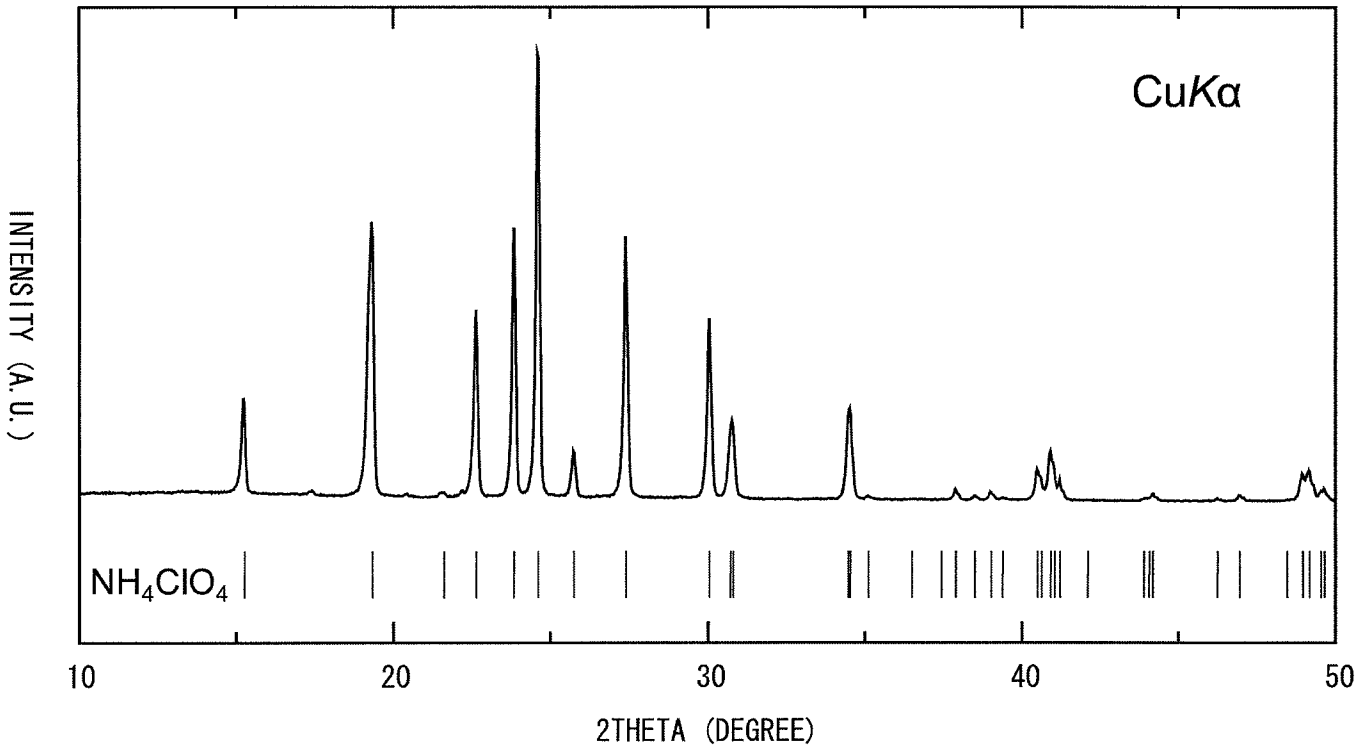
FIG. 32 shows a powder X-ray diffraction spectrum of the crystals obtained by the apparatus for manufacturing a perchlorate according to the eleventh embodiment of the invention.

FIG. 32 shows a powder X-ray diffraction spectrum of the crystals obtained by the present test. In the drawing, the vertical axis indicates the diffraction intensity normalized by the highest X-ray diffraction intensity, and the horizontal axis indicates a diffraction angle of 2θ. When the diffraction spectrum in FIG. 32 and the diffraction spectrum obtained from FIG. 5 of the first embodiment were compared, impurity-induced diffraction rays were observed at locations other than the standard locations (the locations indicated by vertical lines in the graph) of ammonium crystals in FIG. 5, but no impurity-induced diffraction rays were observed in the peak observed in FIG. 32. This result indicates that it is possible to obtain crystals having a high purity by employing the present embodiment.

Meanwhile, in the manufacturing method of the invention, it is difficult to manufacture fine crystals of ammonium perchlorate as large as 1 μm, but it is possible to obtain crystals as large as 100 μm by controlling the degree of supersaturation of perchlorate in the aqueous solution in the cooling and crystallization process.

As the crystallization method, any of the evaporation and crystallization method and the cooling and crystallization method may be used. However, when the electrolyzed anode fluid contains sodium ions which have not moved from the anode section to the cathode section through the cation-exchange membrane or chlorate ions which have not been converted to perchlorate, in the crystallization process, it is preferable to perform the evaporation and concentration process S21 in which the aqueous solution of the perchlorate which has been synthesized by the neutralization reaction, the cooling and crystallization process S22 in which the concentrated fluid is cooled so as to crystallize perchlorate, and the separation process S23 in which the formed crystals are separated from the concentrated fluid. Thereby, the amount of impurities, such as sodium ions, is small and thus does not reach the limit of solubility, and, consequently, the impurities are not formed into the crystals of sodium perchlorate or the like and continuously remain in the aqueous solution. As a result, it becomes possible to obtain the target crystals of perchlorate with a high purity by the cooling and crystallization method.

Thus far, the preferred embodiments of the invention have been described with reference to the drawings, but the invention is not limited to the embodiments. The variety of shapes, combinations, or the like of the respective constituent members shown in the embodiments as described above are simply examples, and a variety of modifications are permitted based on the demand for design or the like within a scope the gist of the invention.

For example, in the embodiment regarding the manufacturing of lithium, lithium chlorate and lithium perchlorate were exemplified as an alkaline metal perchlorate, but the invention is not limited to the application to them. For example, the invention can be applied to methods and apparatuses of manufacturing alkali earth metal perchlorate, such as calcium perchlorate, ammonium perchlorate, silver perchlorate, or the like.

For example, in the embodiments, it is described that both the anode 4 and the cathode 5 are made up of a platinum-coated titanium expanded metal, but the invention is not limited to the above configuration.

As the replacement of the platinum-coated titanium expanded metal of the anode 4, diamond-like carbon, in which a crystalline component containing an extremely small amount of platinum and an amorphous component are mixed, may be used.

As the replacement of the platinum-coated titanium expanded metal of the cathode 5, for example, a titanium expanded metal, an SUS 316L expanded metal, or a nickel expanded metal may be used.

Furthermore, from the viewpoint of corrosion resistance, not only platinum but also a gold-coated titanium expanded metal, an SUS 316L expanded metal, or a nickel expanded metal may be used.

In addition, for example, in the embodiments, it is described that the absorbing agent in the absorption tower 10 is activated charcoal, but the invention is not limited to the above configuration. For example, the absorbing agent may be made up of a substance that is porous and has a large specific surface area, such as zeolite or activated alumina. Meanwhile, when activated charcoal is used as the absorbing agent, it is possible to contribute to a reduction of costs.

In addition, for example, in the embodiments, the electrolysis tank 2 may be a batch-type one or a continuous-type one.

In addition, for example, in the salting out process S7 when ammonium perchlorate is manufactured, it is described that the precipitating agent is chloroform or dichloromethane, but the invention is not limited to the above precipitating agent, and, for example, ether may be used.

In addition, for example, as the method of refining the grain diameter of the crystals of ammonium perchlorate, not only the salting out method as described in the fifth embodiment, but also the freeze-drying method (a public document: 'Ultra fine ammonium perchlorate prepared by the freeze-drying method—when needle-like ultra fine ammonium perchlorate is used', by Makoto Kohga, Masao Suzuki, and Yutaka Hagihara, P. 295 to 300, Vol. 53, No. 6, Industrial Explosives (1992)) may be used in substitution.

In addition, for example, when potassium perchlorate is manufactured by the tenth embodiment, the configurations of the second to fourth embodiments may be applied to the apparatus 41A' of manufacturing potassium perchlorate.

INDUSTRIAL APPLICABILITY

According to the method and apparatus for manufacturing a perchlorate of the invention, it is possible to provide a method of manufacturing a perchlorate which considers the influences on the environment, the reduction in costs for disposal treatments, and the simplification of the manufacturing processes. Furthermore, when perchlorate can be manufactured using the invention, it is possible to easily manufacture a variety of perchlorate according to necessity, and to broaden the types of products manufactured by the manufacturing apparatus.

REFERENCE SIGNS LIST

1A-1E . . . Apparatus for Manufacturing Ammonium Perchlorate (Apparatus for Manufacturing a Perchlorate), 2 . . . Electrolysis Tank, 3 . . . Neutralization Reaction/Evaporation and Crystallization Tank, 4 . . . Anode, 4A . . . Anode Section, 5 . . . Cathode, 5A . . . Cathode Section, 6 . . . Cation Exchange Membrane, 7 . . . Platinum Net (Net-Shaped Body), 10 . . . Absorption Tower, 30 . . . Impurity Removing Tower, 32 . . . Sodium Ion Removing Tank, 33 . . . Salting Out Tank, 41A to 41D . . . Apparatus for Manufacturing Lithium Perchlorate (Apparatus for Manufacturing a Perchlorate), 41A' . . . Apparatus for Manufacturing Potassium Perchlorate (Apparatus for Manufacturing a Perchlorate), 300 . . . Pressure Reducing Mechanism, 53 . . . Neutralization Reaction/Evaporation and Concentration Tank, 54 . . . Cooling and Crystallization Tank, 55 . . . Separation Tank

What is claimed is:

1. A method of manufacturing a perchlorate, comprising:

an electrolysis process in which, using an electrolysis tank in which an anode section provided with an anode and a cathode section provided with a cathode are divided by a cation-exchange membrane, an aqueous solution of sodium chlorate is electrolytically oxidized in the anode section; and a neutralization reaction process in which a substance that becomes alkaline when dissolved in water is added to the aqueous solution of perchloric acid in the anode section, which has been generated by the electrolytic oxidation, so as to synthesize a perchlorate with a neutralization reaction, wherein the anode is an electrode having a platinum catalytic layer on the surface of the substrate, and an absorption process in which at least a part of the platinum that is eluted by the electrolysis process is absorbed and recovered by an absorbent is provided between the electrolysis process and the neutralization process.

2. The method of manufacturing a perchlorate according to claim 1, wherein the alkaline substance that is added to the aqueous solution of perchloric acid in the anode section, which has been generated by the electrolytic oxidation during the neutralization reaction, is ammonia gas or an aqueous solution of ammonia.

3. The method of manufacturing a perchlorate according to claim 1, comprising an evaporation and crystallization process in which perchlorate synthesized by the neutralization reaction process is formed into crystals.

4. The method of manufacturing a perchlorate according to claim 1, comprising:

an evaporation and concentration process in which perchlorate synthesized by the neutralization reaction process is evaporated and concentrated;

a cooling and crystallization process in which the liquid evaporated and concentrated in the evaporation and concentration process is cooled and formed into crystals; and a separation process in which crystals are separated from the liquid cooled and crystallized in the cooling and crystallization process.

5. The method of manufacturing a perchlorate according to claim 1, wherein the anode is an electrode having a noble metal catalytic layer on the surface of the substrate.

6. The method of manufacturing a perchlorate according to claim 1, comprising between the electrolysis process and the neutralization reaction process an impurity removal process in which, from the aqueous solution of perchloric acid in the anode section generated by the electrolysis process, sodium ions and chlorate ions included in the aqueous solution are crystallized and separated as sodium chlorate crystals and sodium perchlorate crystals.

7. The method of manufacturing a perchlorate according to claim 6, comprising between the impurity removal process and the neutralization reaction process a sodium ion removal process in which, using a cation exchange tank filled with a hydrogen ion-type ion-exchange resin that substitutes sodium ions with hydrogen ions, sodium ions included in the aqueous solution of perchloric acid after the impurity removal process are substituted with hydrogen ions, thereby removing sodium ions.

8. An apparatus for manufacturing a perchlorate, comprising:

an electrolysis tank in which an anode section provided with an anode and a cathode section provided with a cathode are divided by a cation-exchange membrane, and an aqueous solution of sodium chlorate is electrolytically oxidized in the anode section; and a neutralization reaction tank in which a substance that becomes alkaline when dissolved in water is added to the aqueous solution of perchloric acid in the anode section, which has been generated by the electrolytic oxidation, so as to synthesize a perchlorate by a neutralization reaction, wherein the anode is an electrode having a platinum catalytic layer on the surface of the substrate, and an absorption tower in which at least a part of the platinum that is eluted by the electrolytic oxidation is absorbed and recovered by an absorbent is provided between the electrolysis tank and the neutralization reaction tank.

9. The apparatus for manufacturing a perchlorate according to claim 8, comprising an evaporation and crystallization tank in which the aqueous solution of a perchlorate synthesized by the neutralization reaction tank is evaporated and formed into crystals.

10. The apparatus for manufacturing a perchlorate according to claim 8, comprising:

an evaporation and concentration tank in which the aqueous solution of the perchlorate synthesized in the neutralization reaction tank is evaporated and concentrated;

a cooling and crystallization tank in which the liquid evaporated and concentrated in the evaporation and concentration tank is cooled and formed into crystals; and a separation tank in which crystals are separated from the liquid cooled and crystallized in the cooling and crystallization tank.

11. The apparatus for manufacturing a perchlorate according to claim 10, wherein the neutralization reaction tank and the evaporation and concentration tank are provided in the same tank.

12. The apparatus for manufacturing a perchlorate according to claim 8, wherein the anode is an electrode having a noble metal catalytic layer on the surface of the substrate.

13. The apparatus for manufacturing a perchlorate according to claim 8, comprising between the electrolysis tank and the neutralization reaction tank an evaporation and concentration tank and a cooling and crystallization tank in which, from the aqueous solution of perchloric acid in the anode section generated by the electrolytic oxidation, sodium ions and chlorate ions included in the aqueous solution are crystallized and separated as sodium chlorate crystals and sodium perchlorate crystals.

14. The apparatus for manufacturing a perchlorate according to claim 8, comprising between the cooling and crystallization tank and the neutralization reaction tank a cation exchange tank which is filled with a hydrogen ion-type ion-exchange resin that substitutes sodium ions with hydrogen ions, and substitutes sodium ions included in the aqueous solution of perchloric acid after cooling and crystallization.

* * * * *